US007500836B2

(12) United States Patent
Shimizu et al.

(10) Patent No.: US 7,500,836 B2
(45) Date of Patent: Mar. 10, 2009

(54) COMPRESSOR

(75) Inventors: Takashi Shimizu, Sakai (JP); Yoshitaka Shibamoto, Sakai (JP); Yoshinari Asano, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/562,565

(22) PCT Filed: Jul. 8, 2004

(86) PCT No.: PCT/JP2004/009730

§ 371 (c)(1),
(2), (4) Date: Dec. 27, 2005

(87) PCT Pub. No.: WO2005/010373

PCT Pub. Date: Feb. 3, 2005

(65) Prior Publication Data

US 2006/0188382 A1 Aug. 24, 2006

(30) Foreign Application Priority Data

Jul. 9, 2003 (JP) ..... 2003-272266
Dec. 26, 2003 (JP) ..... 2003-435278

(51) Int. Cl.
*F04C 18/00* (2006.01)

(52) U.S. Cl. ..... 418/59

(58) Field of Classification Search ..... 418/241, 418/54, 57, 61.1, 61.3, 62, 63, 64, 66, 67, 418/91, 157, 159, 130; 277/606, 608, 609, 277/618–619, 370, 377, 404
See application file for complete search history.

(56) References Cited

U.S. PATENT DOCUMENTS 4,055,199 A * 10/1977 Herman ..... 137/590
5,544,896 A * 8/1996 Draskovich et al. ..... 277/404
5,593,294 A * 1/1997 Houghtby et al. ..... 418/55.1
5,720,602 A * 2/1998 Hill et al. ..... 418/55.4
6,062,834 A * 5/2000 Masumoto et al. ..... 418/55.4

FOREIGN PATENT DOCUMENTS

JP 56-132386 U 10/1981
JP 01-203688 A 12/1989
JP 01-313692 A 12/1989
JP 03-202693 A 9/1991
JP 2003-97447 A 4/2003

* cited by examiner

*Primary Examiner*—Thomas Denion
*Assistant Examiner*—Douglas J. Duff
(74) *Attorney, Agent, or Firm*—Global IP Counselors

(57) ABSTRACT

A compressor has a cylindrical sealed container, a compression mechanism and a motor. The compression mechanism has a cylinder with an intake passage passing through the cylinder in the radial direction. The sealed container has a coupling member having a tip end face facing the periphery of the intake passage in the outer face of the cylinder and a base end to which an intake pipe is mounted. The tip end face of the coupling member serves as a flat sealed face. A concave groove is formed in a peripheral part around the intake passage in the outer face of the cylinder and an O ring is fitted therein. The O ring is pressed against the tip end face of the coupling member, sealing a gap between the cylinder and the coupling member.

24 Claims, 10 Drawing Sheets

COMPRESSOR

CROSS-REFERENCE TO RELATED APPLICATIONS

This U.S. National stage application claims priority under 35 U.S.C. §119(a) to Japanese Patent Application Nos. 2003-272266, filed in Japan on Jul. 9, 2003, and 2003-435278, filed in Japan on Dec. 26, 2003, the entire contents of which are hereby incorporated herein by reference.

TECHNICAL FIELD

The present invention relates to a compressor in which a sealed container accommodates a compression mechanism and a motor for driving and rotating a drive shaft of the compression mechanism, and particularly belongs to a technology in a construction for elastically supporting a compression mechanism and a motor to a sealed container.

BACKGROUND ART

Hermetic rotary compressors have been known conventionally in which a motor is mounted on the upper side of a compression mechanism and is integrated therewith while a coil spring is interposed between the compression mechanism and the bottom wall of a sealed container (see Japanese Patent Application Laid Open Publication No. 1-203688A, for example). In the compressors of this kind, the compression mechanism and the motor are supported elastically for suppressing vibration transferring from the compression mechanism and the motor to the sealed container, thereby reducing noise generated during operation.

The compressor disclosed in Japanese Patent Application Laid Open. Publication No. 1-203688A is of generally-called high pressure dome type. In this compressor, gas compressed in the compression mechanism is discharged into the sealed container. In the compressor, an intake pipe for introducing intake gas to the inside of the sealed container is fixed to the bottom wall of the sealed container. The downstream end of the intake pipe is arranged so that the center line thereof agrees with the axial center of the drive shaft of the compression mechanism. On the other hand, an intake passage that communicates with a compression chamber of the compression mechanism is formed in a tubular shape. The upstream end of the intake passage is arranged so that the center line thereof agrees with the center line of the downstream end of the intake pipe, and is inserted in the intake pipe. An O ring is provided between the outer peripheral face of the intake passage and the inner peripheral face of the intake pipe.

Further, in the compressor disclosed in Japanese Patent Application Laid Open Publication No. 1-203688A, a pin coaxial with the drive shaft is provided at the top of the sealed container and is inserted in the upper part of the motor, thereby restricting displacement of the compression mechanism and the motor only to the axial direction and the peripheral direction of the drive shaft. In the compressor, the intake passage and the intake pipe are arranged coaxial with the drive shaft, the intake passage is inserted in the intake pipe, and the O ring is provided therebetween, thereby sealing the intake pipe with the intake passage without preventing the displacement of the compression mechanism and the motor.

PROBLEMS THAT THE INVENTION IS TO SOLVE

In rotary compressors, a compression chamber of a compression mechanism is formed between the outer peripheral face of a piston fitted to a drive shaft and the inner peripheral face of a cylinder. Accordingly, the downstream end of an intake passage connected to the compression chamber opens in the inner face of the cylinder at a part apart from the axial center of the drive shaft. Under the circumstances, in the compressor in Japanese Patent Application Laid Open Publication No. 1-203688A, the intake passage is curved so that the center line at the upstream end of the intake passage agrees with the axial center of the drive shaft.

However, with the construction as in Japanese Patent Application Laid Open Publication No. 1-203688A, the efficiency of the compressor lowers. In detail, in the compressor of Japanese Patent Application Laid Open Publication No. 1-203688A, the gas flows to the compression mechanism through the curved intake passage, resulting in large pressure loss of the gas until it reaches the compression chamber. For this reason, the gas density at the time when it flows into the compression chamber lowers, thereby inviting lowering in efficiency of the compressor.

The present invention has been made in view of the above problems and has its object of firmly sealing a gap between an intake passage and an intake pipe with no increase in pressure loss of gas sucked to a compression mechanism without preventing displacement of the compression mechanism and a motor by devising a sealing structure of the intake passage and the intake pipe of the compression mechanism in the case where the compressor and the motor are elastically supported to a sealed container.

SUMMARY OF THE INVENTION

In the present invention, an intake pipe faces an opening part of an intake passage in the outer face of a compressor, either of the peripheral portion of the intake passage in the outer face of a cylinder and an inner face of a sealed container serves as a flat sealed face, and the intake pipe and the intake passage are connected with each other by means of a sealing mechanism including a sealing member pressed against the sealed face.

A first invention directs to a compressor including: a cylindrical sealed container (10) to which an intake pipe (42) and a discharge pipe (14) are connected; a compression mechanism (20) which compresses gas introduced from the intake pipe (42) and discharges it into the sealed container (10); a motor (30) connected to a drive shaft (31) of the compression mechanism (20); and an elastic support member (65) that supports the compression mechanism (20) and the motor (30), both of which are accommodated in the sealed container (10).

In the compressor, an intake passage (40) which passes through the compression mechanism (20) in a radial direction thereof and which opens in an outer face of the compression mechanism (20) is formed in the compression mechanism (20), the intake pipe (42) is arranged so as to face at a terminal end thereof an opening part of the intake passage (20) in the outer face of the compression mechanism (20), one of a peripheral part of the intake passage (40) in the outer face of the compression mechanism (20) and a part of an inner face of the sealed container (10) which faces the peripheral part serves as a sealed face, and a sealing mechanism (S) including a sealing member (45) pressed against the sealed face for connecting the intake pipe (42) and the intake passage (40) with each other is provided for sealing a gap between the compression mechanism (20) and the sealed container (10).

With the above construction, when the drive shaft (31) of the compression mechanism (20) is driven and rotated by the motor (30), gas in the intake pipe (42) flows into the intake passage (40) connected by mean of the sealing mechanism (S) thereto. The intake passage (40) passes through the compression mechanism (20) in the radial direction thereof and has a short and straight shape. The gas from the intake pipe (42) is sucked into the compression mechanism (20) through the short and straight intake passage (40).

In the compressor, the outer face of the compression mechanism (20) faces the inner face of the sealed container (10). Also, in the compressor, either of the outer face of the compression mechanism (20) and the inner face of the sealed container (10) which face each other serves as the sealed face. The sealing mechanism (S) seals the compression mechanism (20) with the sealed container (10) by pressing the sealing member (45) against the sealed face.

When the compression mechanism (20) vibrates during operation of the compressor to displace itself in the axial direction or the peripheral direction of the drive shaft (31), the outer face of the compression mechanism (20) is displaced substantially in a direction in parallel with the inner face of the sealed container (10). At that time, the sealing member (45) of the sealing mechanism (S) slides on the sealed face of the compression mechanism (20) or of the sealed container (10) to seal the compression mechanism (20) with the sealed container (10) without preventing the displacement of the compression mechanism (20).

In the second invention, in the compressor of the first invention, the part of the inner face of the sealed container (10) which faces the peripheral part of the intake passage (40) in the outer face of the compression mechanism (20) serves as the sealed face, an annular concave groove (23*a*) is formed so as to surround the opening part of the intake passage (40) in the outer face of the compression mechanism (20), the sealing member (45) is formed in a ring shape, is fitted in the concave groove (23*a*), and is interposed between a bottom face of the concave groove (23*a*) and the sealed face so as to be deformed elastically, and the concave groove (23*a*) and the sealing member (45) compose the sealing mechanism (S).

With the above construction, the part of the inner face of the sealed container (10) which faces the peripheral part of the intake passage (40) in the outer face of the compression mechanism (20) serves as the sealed face. The sealing member (45) is fitted in the concave groove (23*a*) of the compression mechanism (20). The sealing member (45) is squeezed between the bottom face of the concave groove (23*a*) and the inner face of the sealed container (10) to be crushed in the thickness direction. The sealing member (45) adheres to the sealed face that the inner face of the sealed container (10) forms and the bottom face of the concave groove (23*a*) to seal a part between the compression mechanism (20) and the sealed container (10). When the compression mechanism (20) vibrates during the operation, the sealing member (45) is displaced together with the compression mechanism (20) to slide on the sealed face of the sealed container (10).

In the third invention, the sealing member is an O ring (45) in the second invention.

In the above constitution, the O ring (45) as the sealing member is fitted in the concave groove (23*a*) of the compression mechanism (20). The O ring (45) is crushed in the thickness direction to adhere to the compression mechanism (20) and the sealed container (10).

In the fourth invention, the sealing member (70) is formed in a U-shape in section so as to be deformed in a thickness direction elastically in the second invention.

In the above constitution, the sealing member (70) has a U-shape in section. The sealing member (70) adheres at one side face in the thickness direction thereof to the bottom face of the concave groove (23*a*) while adhering at the other side face thereof to the inner face of the sealed container (10). The sealing member (70) has a hollow in section. Accordingly, the sealing member (70) is easy to be deformed in the thickness direction, compared with an O ring that is solid in section.

In the fifth invention, in the compressor of the first invention, the sealed container (10) includes a coupling member (43) having a tip end face facing the peripheral part of the intake passage (40) in the outer face of the compression mechanism (20) and a base end to which the intake pipe (42) is mounted, the peripheral part of the intake passage (40) in the outer face of the compression mechanism (20) serves as the sealed face, a tip end part of the coupling member (43) is formed in a cylindrical shape and composes a cylindrical portion (71), the sealing member (72) is formed in a ring shape rectangular in section and is fitted freely to the cylindrical portion (71), and the sealing mechanism (S) includes a pressing member (75) for making pressing force to work on the sealing member (72) so that a tip end face of the sealing member (72) is in contact with the sealed face.

In the above construction, the outer face of the compression mechanism (20) serves as the sealed face. The sealing member (72) is freely fitted to the cylindrical portion (71) of the coupling member (43) so as to be movable in the axial direction of the cylindrical portion (71). The tip end face of the sealing member (72) is pressed against the sealed face by the pressing member (75). When the compression mechanism (20) vibrates during the operation, the sealing member (72) provided at the coupling member (43) slides on the sealed face of the compression mechanism (20) that is being displaced. When the compression mechanism (20) is displaced in a direction perpendicular to the tip end face of the coupling member (43) in association with vibration of the compression mechanism (20), the sealing member (72) follows the displacement of the compression mechanism (20) to shift in the axial direction of the cylindrical portion (71), so that the sealing member (72) is kept adhering to the sealed face of the compression mechanism (20).

In the sixth invention, the pressing member is a spring (75) that is in contact with a base end face of the sealing member (72) and the coupling member (43) in the fifth invention.

In the above construction, the spring (75) is arrange between the base end face of the sealing member (72) and the coupling member (43). The tip end face of the sealing member (72) is pressed against the sealed face by this spring (75).

In the seventh invention, wherein an entire inner peripheral face of the sealing member (72) slides on an outer peripheral face of the cylindrical portion (71) in the sixth invention.

In the above construction, the sealing member (72) freely fitted to the cylindrical portion (71) slides at the entire inner peripheral face thereof around the outer peripheral face of the cylindrical portion (71). Namely, the inner diameter of the sealing member (71) is nearly the same as the outer diameter of the cylindrical portion (71) with little or no gap between the sealing member (72) and the cylindrical portion (71).

In the eighth invention, in the compressor of the fifth invention, an inner peripheral groove (72*a*) is formed around an entire perimeter of an inner peripheral face of the sealing member (72), and the sealing mechanism (S) include an O ring (76) fitted in the inner peripheral groove (72*a*) so as to be in contact with an outer peripheral face of the cylindrical portion (71).

In the above construction, the sealing member (72) is freely fitted to the cylindrical portion (71) with the O ring (76) fitted in the inner peripheral groove (72*a*) of the sealing member (72). The outer peripheral face of the O ring (76) adheres to the bottom face of the inner peripheral groove (72*a*) of the sealing member (72) while the inner peripheral face of the O ring (76) adheres to the outer peripheral face of the cylindrical portion (71). When the sealing member (72) moves in the axial direction of the cylindrical portion (71), the O ring (76) slides on the outer peripheral face of the cylindrical portion (71).

In the ninth invention, the pressing member is an O ring (77) in contact with both a base end face of the sealing member (72) and the coupling member (43) in the fifth invention.

In the above construction, the O ring (77) is arranged between the base end face of the sealing member (72) and the coupling member (43). The O ring (77) adheres to both the sealing member (72) and the coupling member (43). When the O ring (77) is deformed elastically in the thickness direction, the tip end face of the sealing member (72) is pressed against the sealed face by restoring force thereof.

The tenth invention, in the compressor of the first invention, the sealed container (10) includes a cylindrical shell (11) extending vertically, an upper head (12) that blocks an upper end of the shell (11), and a lower head (13) that blocks a lower end of the shell (11), a lower end of the upper head (12) is fitted inside the shell (11), and a stopper (32*a*) that restricts the amount of displacement of the compression mechanism (20) and the motor (30) by being in contact with the lower end of the upper head (12) is provided to the compression mechanism (20) or the motor (30) which are supported by the elastic support member (65).

In the above construction, the upper head (12) is mounted to the shell (11) so that the lower end of the upper head (12) is located inside the inner peripheral face of the shell (11). Large excitation force may work on the compression mechanism (20) and the motor (30) in transportation of the compressor in some cases. In these case, when the compression mechanism (20) and the motor (30) are displaced upward by a predetermined amount, the stopper (32*a*) is in contact with the lower end of the upper head (12), thereby restricting the upward displacement of the compression mechanism (20) and the motor (30).

In the eleventh invention, in the compressor of the first invention, the compression mechanism (20) is arranged below the motor (30) in the sealed container (10), the compression mechanism (20) is fixed to the elastic support member (65) by means of a plate-shaped stay member (61) and a discharge passage (57) for discharging compressed gas into the sealed container (10) is formed in a lower face of the compression mechanism (20), and the stay member (61) covers an opening part of the discharge passage (57) in the lower face of the compression mechanism (20).

In the above construction, the compression mechanism (20) is fixed to the elastic support member (65) under the motor (30) by means of the stay member (61). Gas compressed in the compression mechanism (20) is discharged from the discharge passage (57) open in the lower face of the compression mechanism (20) into the sealed container (10). The opening part of the discharge passage (57) is covered with the stay member (61), so that the gas compressed in the compression mechanism (20) is discharged from the discharge port (67) to the space between the compression mechanism (20) and the stay member (61). If the upper muffler (59) is provided above the compression mechanism (20) and the communication hole for allowing the space between the compression mechanism (20) and the stay member (61) and the upper muffler (59) to communicate with each other is formed in the compression mechanism (20), the discharge gas discharged between the lower face of the compression mechanism (20) and the stay member (61) is discharged to the upper muffler (59) through the communication hole.

In the twelfth invention, in the compressor of the fifth invention, in the sealing mechanism (S), an outer peripheral groove (71*a*) is formed around an entire perimeter of an outer peripheral face of the cylindrical portion (71), an annular ring member (78) a part of which is cut out is fitted in the outer peripheral groove (71*a*), an outer peripheral face of the ring member (78) is pressed against an inner peripheral face of the sealing member (72) by restoring force of the elastically deformed ring member (78) which expands naturally in a radial direction so as to seal a gap between the cylindrical portion (71) and the sealing member (82).

In the above construction, the outer peripheral groove (71*a*) is formed around the entire perimeter of the part of the outer peripheral face of the cylindrical portion (71) which faces the inner peripheral face of the sealing member (72). A ring member (78) is fitted in the outer peripheral groove (71*a*). The ring member (78) fitted in the outer peripheral groove (71*a*) is surrounded by the sealing member (72) and is compressed and contracts in the radial direction to be deformed elastically. The outer peripheral face of the thus elastically deformed ring member (78) is pressed against the inner peripheral face of the sealing member (72) by restoring force of the ring member (78) which expands naturally in the radial direction. The ring member (78) fitted in the outer peripheral groove (71*a*) is pressed against the inner peripheral face of the sealing member (72), sealing the gap between the cylindrical portion (71) and the sealing member (72).

In the thirteenth invention, the sealing member (72) and the ring member (78) are made of metal in the twelfth invention.

In the above constitution, frictional drag is caused between the outer peripheral face of the ring member (78) and the inner peripheral face of the sealing member (72). This frictional drag is caused between the metal ring member (78) and the metal sealing member (72). Referring to the case where an O ring is fitted in the outer peripheral groove (71*a*), frictional drag is caused between the O ring, which is made of rubber, and the sealing member (72), which is made of metal. Frictional drag between metals is smaller than that between metal and rubber. For this reason, the frictional drag becomes smaller between the metal sealing member (72) and the metal ring member (78) than between the metal sealing member (72) and the rubber O ring. Hence, the ring member (78) slides on the sealing member (72) more smoothly than the O ring.

In the fourteenth invention, the compressor of the first invention further includes: a differential pressure canceling mechanism (52) that makes intake gas pressure to work on the compression mechanism (20) so as to reduce pressing force by discharge gas within the sealed container (10) which works on the compression mechanism (20) towards the intake pipe (42).

In the above construction, discharge gas pressure within the sealed container (10) works on the compression chamber (20) during the operation of the hermetic compressor. The intake pipe (42) is connected to the intake passage (40) of the compression mechanism (20), so that intake gas pressure introduced to the intake passage (40) also works on the compression mechanism (20). The differential pressure canceling mechanism (52) makes the intake gas pressure to work, in addition, on the compression mechanism (20) that has already received the discharge gas pressure and the intake gas pressure. As a result, forces to work on the compression mechanism (20) by the discharge gas pressure within the sealed container (10), the intake gas pressure introduced to the intake passage (40), and the intake gas pressure working by the differential pressure canceling mechanism (52) cancel one another, thereby reducing pressing force towards the intake passage (40) which works on the compression mechanism (20).

In the fourteenth invention, the differential pressure canceling mechanism (52) may be a mechanism for merely reducing the pressure force towards the intake passage (40) which works on the compression mechanism (20) or for reducing the pressure force to zero.

In the fifteenth invention, in the compressor of the fourteenth invention, the compression mechanism (20) is composed of a rotary fluid machinery in which a compression chamber (22) is formed between an inner peripheral face of a cylinder (23) and an outer peripheral face of a piston (25), and the differential pressure canceling mechanism (52) makes the intake gas pressure to work on an outer face of the cylinder (23) of the compression mechanism (20).

In the above construction, the differential pressure canceling mechanism (52) makes the intake gas pressure to work on the outer face of cylinder (23), so that the pressing force towards the intake passage (40) which the compression mechanism (20) receives from the discharge gas in the sealed container (10), that is, the pressing force in the radial direction of the cylinder (23) is reduced. In this way, the differential force canceling mechanism (52) makes the intake gas pressure to work directly on the cylinder (23) of the compression mechanism (20) in which the intake passage (40) is formed.

In the sixteenth invention, the compressor of the fifteenth invention, the differential pressure canceling mechanism (52) makes the intake gas pressure to work on a part opposite the intake passage (40) in the outer face of the cylinder (23).

In the above construction, the differential pressure canceling mechanism (52) makes the intake gas pressure to work on the part of the outer face of the cylinder (23) which is on the opposite side of the intake passage (40) passing through the cylinder (23). Whereby, displacement of the compression mechanism (20) and the motor (30) is suppressed reliably even if the differential force canceling mechanism (52) makes the intake gas pressure to work only on one part of the cylinder (23).

In the seventeenth invention, in the compressor of the fifteenth invention, the differential pressure canceling mechanism (52) includes an intake pressure chamber (50) formed between the inner face of the sealed container (10) and the outer face of the cylinder (23) and a communication passage (51) that allows the intake pressure chamber (50) to communicate with the intake passage (40) of the compression mechanism (20), and gas pressure of the intake pressure chamber (50) works on the cylinder (23).

In the above construction, the intake gas pressure in the intake passage (40) is introduced into the intake pressure chamber (50). The intake pressure chamber (50) is formed between the inner face of the sealed container (10) and the outer face of the cylinder (23). The intake gas pressure introduced in the intake pressure chamber (50) works on the outer face of the cylinder (23).

In the eighteenth invention, in the compressor of the seventeenth invention, the communication passage (51) of the differential pressure canceling mechanism (52) is formed in the cylinder (23).

In the above construction, the communication passage (51) of the differential force canceling mechanism (52) is formed in the cylinder (23) composing the compression mechanism (20), thereby eliminating the need for providing an additional member composing the communication passage (51).

In the nineteenth invention, in the compressor of seventeenth invention, the communication passage (51) of the differential pressure canceling mechanism (52) is formed in an arc shape extending along the inner peripheral face of the cylinder (23).

In the above construction, the communication passage (51) is formed between the outer face and the inner face of the cylinder (23), thereby inhibiting thermal conduction from the outer face towards the inner face of the cylinder (23). In other words, heat of the high-temperature discharge gas in the sealed container (10) is hard to transfer to the compression chamber (22).

The twentieth invention directs to a compressor including: a cylindrical sealed container (10) to which an intake pipe (42) and a discharge pipe (14) are connected; a compression mechanism (20) which compresses gas introduced from the intake pipe (42) and discharges it into the sealed container (10); a motor (30) connected to a drive shaft (31) of the compression mechanism (20); and an elastic support member (65) that supports the compression mechanism (20) and the motor (30), both of which are accommodated in the sealed container (10).

In the above compressor, the compression mechanism (20) has a cylindrical outer shape, an intake passage (40) opens in an outer peripheral face of the compression mechanism (20), the intake pipe (42) is arranged so that a terminal end thereof faces an opening part of the intake passage (40) in the outer peripheral face of the compression mechanism (20), and a sealing mechanism (S) for forming a low-pressure space (81) that communicates with the intake passage (40) and the intake pipe (42) is provided in a gap between the outer peripheral face of the compression mechanism (20) and an inner peripheral face of the sealed container (10) which are face each other.

In the above construction, the entire outer peripheral face of the compression mechanism (20) faces the inner peripheral face of the sealed container (10). An annular gap is formed between the outer peripheral face of the compression mechanism (20) and the inner peripheral face of the sealed container (10). In the compressor, the sealing mechanism (S) is provided for forming the low-pressure space (81) in the gap between the outer peripheral face of compression mechanism (20) and the inner peripheral face of the sealed container (10). The part partitioned by the sealing mechanism (S) in the gap between the compression mechanism (20) and the sealed container (10) serves as the low-pressure space (81) communicating with the intake pipe (42) and the intake passage (40).

In the above construction, when the drive shaft (31) of the compression mechanism (20) is driven and rotated by the motor (30), gas in the intake pipe (42) flows into the intake passage (40) through the low-pressure space (81). The terminal end of the intake pipe (42) faces the opening part of the intake passage (40) in the outer face of the compression mechanism (20). The gas flowing in the intake passage (20) of the compression mechanism (20) is compressed by and discharged from the compression mechanism (20).

As described above, the low-pressure intake gas is introduced into the intake passage (40) of the compression mechanism (20) through the intake pipe (42). When taking account of the fact that the discharge gas pressure works on all parts of the outer peripheral face of the compression mechanism (20) other than the intake passage (40), the gas pressure working in the radial direction of the compression mechanism (20) may become uneven. When the compression mechanism (20) is urged towards the intake pipe (42) by the gas pressure so as to be in contact with the sealed container (10), vibration transferring from the compression mechanism (20) to the sealed container (10) is interrupted insufficiently.

In contrast, in the twentieth invention, the low-pressure space (81) is formed at the entire perimeter of a part of the gap between the outer peripheral face of the compression mechanism (20) and the inner peripheral face of the sealed container (10). Accordingly, the inner pressure of the low-pressure space (81), that is, the intake gas pressure works on the entire perimeter of the outer peripheral face of the compression mechanism (20). Thus, uniform gas pressure works in the radial direction of the compression mechanism (20), resulting in no influence of the gas pressure working on the compression mechanism (20). Further, displacement of the compression mechanism (20) towards the intake pipe (42) by the gas pressure is prevented. Also, vibration transferring from the compression mechanism (20) to the sealed container (10) is interrupted reliably because the compression mechanism (20) is never in contact with the sealed container (10).

In the twenty-first invention, in the compressor of the twentieth invention, at least one O ring (79) is arranged around an entire perimeter of the outer peripheral face of the compression mechanism (20) at each side of the opening part of the intake passage (40) in the outer peripheral face of the sealing mechanism (S).

In the above construction, the O rings (79) are provided around the entire perimeter of the outer peripheral face of the compression mechanism (20) at both sides of the opening part of the intake passage (40). The O rings (79) are squeezed between the outer peripheral face of the compression mechanism (20) and the inner peripheral face of the sealed container (10) so as to be crushed in the thickness direction. The adhesion of the O ring (79) to the outer peripheral face of the compression mechanism (20) and the inner peripheral face of the sealed container (10) forms the low-pressure space (81) communicating with the intake passage (40) around the entire perimeter in the gap between the compression mechanism (20) and the sealed container (10).

In the twenty-second invention, in the compressor of twentieth invention, at least one concave groove (23*c*) is formed around an entire perimeter in the outer peripheral face of the compression mechanism (20) at each side of the opening part of the intake passage (40), the sealing mechanism (S) includes the concave groove (23*c*) and a ring member (80) in an annular shape a part of which is cut out and which is fitted in the concave groove (23*c*), and an outer peripheral face of the ring member (80) is pressed against the inner peripheral face of the sealed container (10) by restoring force of the elastically deformed ring member (80) which expands naturally in a radial direction so that a gap between the compression mechanism (20) and the sealed container (10) is sealed.

In the above construction, the concave grooves (23*c*) are formed around the entire perimeter of the outer peripheral face of the compression mechanism (20) at both sides of the opening part of the intake passage (40). The ring member (80) is fitted in each of the concave grooves (23*c*). The ring member (80) fitted in each concave groove (23*c*) is surrounded by the sealed container (10) and is compressed and contracts in the radial direction so as to be deformed elastically. The outer peripheral face of the elastically deformed ring member (80) is pressed against the inner peripheral face of the sealed container (10) by restoring force of the ring member (80) which expands naturally in the radial direction. The pressing of the ring members (80) fitted in the concave grooves (23*c*) against the inner peripheral face of the sealed container (10) seals the gap between the compression mechanism (20) and the sealed container (10), forming the low-pressure space (81) that communicates with the intake passage (40).

In the twenty-third invention, the ring member (80) of the twenty-second invention is made of metal.

In the above constitution, frictional drag is caused between the outer peripheral face of the ring member (80) and the inner peripheral face of the sealed container (10). The sealed container (10) is made of metal in general, and this frictional drag is caused between the metal ring member (80) and the metal sealed container (10). Referring to the case where an O ring is fitted in the concave groove (23*c*), frictional drag is caused between the O ring, which is made of rubber, and the sealed container (10), which is made of metal. Frictional drag between metals is smaller than that between metal and rubber. For this reason, the frictional drag becomes smaller between the metal sealed container (10) and the metal ring member (80) than between the metal sealed container (10) and the rubber O ring. Hence, the ring member (80) slides on the sealed container (10) more smoothly than the O ring.

In the twenty-fourth invention, an oil return passage (29) passing through the compression mechanism (20) in an axial direction thereof is formed in the compression mechanism (20) in the twentieth invention.

In the above construction, the oil return passage (29) is formed in the compression mechanism (20). Refrigerator oil for lubricating the compression mechanism (20) is mixed with the gas discharged from the compression mechanism (20). The refrigerator oil is separated from the gas in the sealed container (10) until it reaches the discharge pipe (14). The gap between the outer peripheral face of the compression mechanism (20) and the inner peripheral face of the sealed container (10) is sealed by the sealing mechanism (S). Namely, the sealing mechanism (S) partitions the sealed container (10) into two spaces. In this invention, the oil return passage (29) is provided in the compression mechanism (20), so that the refrigerant oil separated from the gas moves from a space filled with the discharge gas in the sealed container (10) to the other space through the oil return passage (29).

Effects of the Invention

In the first invention, the intake pipe (42) faces the opening part of the intake passage (40) in the outer face of the compression mechanism (20) and the sealing member (45) is pressed against the sealed face of either one of the outer face of the compression mechanism (20) and the inner face of the sealed container (10), thereby sealing the compression mechanism (20) with the sealed container (10). Hence, the sealing member (45) slides on the sealed face of the compression mechanism (20) or the sealed container (10) to seal the compression mechanism (20) with the sealed container (10) without preventing displacement of the compression mechanism (20) even when the compression mechanism (20) is displaced in the axial direction or the peripheral direction of the drive shaft (31) in the operation of the compressor.

As described above, according to the first invention, the sealing between the compression mechanism (20) and the sealed container (10) can be secured without preventing displacement of the compression mechanism (20) in the operation of the compressor even in the case where the intake passage (40) is formed so as to pass through the compression mechanism (20) in the radial direction thereof. Therefore, according to this invention, the sealing mechanism (S) firmly seals the compression mechanism (20) with the sealed container (10) which are displaced relatively while increase in pressure loss of gas to be sucked in the intake passage (40) is avoided by forming the intake passage (40) straight and comparatively short. Further, the degree of freedom in displacement of the compression mechanism (20) is reserved, thereby reducing vibration transferring from the compression mechanism (20) to the sealed container (10).

In the second invention, the concave groove (23*a*) formed in the compression mechanism (20) and the sealing member (45) fitted therein compose the sealing mechanism (S). Hence, the sealing mechanism (S) can be realized with the simple construction, suppressing increase in cost of the compressor which is involved by installation of the sealing mechanism (S).

In the third invention, the widely and generally used O ring (45) is used as the sealing member, attaining further suppression of the increase in cost of the compressor which is involved by installation of the sealing mechanism (S).

In the fourth invention, the sealing member (70) is formed in a U-shape in section so as to be deformed easily in the thickness direction. When the compression mechanism (20) is displaced in the direction perpendicular to the inner face of the sealed container (10) in association with vibration of the compression mechanism (20), the sealing member (70) is deformed easily in the thickness direction in association with the displacement of the compression mechanism (20) to reduce the excitation force transferring from the compression mechanism (20) to the sealed container (10). Thus, according to this invention, vibration transferring from the compression mechanism (20) to the sealed container (10) can be further reduced.

In the fifth invention, the sealing member (72) is freely fitted to the cylindrical portion (71) and is pressed by the pressing member (75) against the sealed face of the outer face of the compression mechanism (20). Therefore, the tip end face of the sealing member (72) can be kept adhering to the sealed face even when the compression mechanism (20) is displaced in association with vibration of the compression mechanism (20), thereby further securing the sealing between the compression mechanism (20) and the coupling member (43).

In the sixth invention, the spring (75) pushes the base end face of the sealing member against the sealed face. When the compression mechanism (20) is displaced in the direction perpendicular to the tip end face of the coupling member (43) in association with vibration of the compression mechanism (20), the spring (75) is deformed to reduce the excitation force transferring from the compression mechanism (20) to the sealed container (10) sufficiently, thereby further reducing vibration transferring from the compression mechanism (20) to the sealed container (10).

In the seventh invention, the sealing member (72) is in contact with and slides, at the entire inner peripheral face thereof, on the outer peripheral face of the cylindrical portion (71), so that little or no gap is present between the inner peripheral face of the sealing member (72) and the outer peripheral face of the cylindrical portion (71). Hence, according to this invention, the sealing member (72) can move freely along the cylindrical portion (71) while the sealing member (72) is sealed with the cylindrical portion (71).

In the eighth invention, the O ring (76) is fitted in the inner peripheral groove (72*a*) of the sealing member (72) so as to seal the inner peripheral face of the sealing member (72) with the outer peripheral face of the cylindrical portion (71). Hence, the space between the inner peripheral face of the sealing member (72) and the outer peripheral face of the cylindrical portion (71) can be set wide while the sealing between the sealing member (72) and the cylindrical portion (71) is secured. Further, with the widened space between the inner peripheral face of the sealing member (72) and the outer peripheral face of the cylindrical portion (71), the compression mechanism (20) that is being displaced during the operation can be sealed with the sealed container (10) firmly.

This point of view will be described. In the operation of the compressor, the outer face of the compression mechanism (20) may be displaced with inclination to the inner face of the sealed container (10). In order to secure the sealing between the compression mechanism (20) and the sealed container (10) under this state, it is preferable to incline the sealing member (72) so that the entire tip end face of the sealing member (72) is allowed to adhere to the outer face of the compression mechanism (20). Further, if the space between the inner peripheral face of the sealing member (72) and the outer peripheral face of the cylindrical portion (71) is set wide, the sealing member (72) is out of contact from the cylindrical portion (71) even if the sealing member (72) follows the compression mechanism (20) to incline.

According to the eighth invention, the sealing member (72) can surely follow displacement of the compression mechanism (20) and the compression mechanism (20) is sealed with the sealed container (10) firmly with the tip end face of the sealing member (72) adhering to the outer face of the compression mechanism (20). Further, ensured following of the sealing member (72) to displacement of the compression mechanism (20) reduces vibration transferring from the compression mechanism (20) to the sealed container (10) through the sealing member (72).

In the ninth invention, the widely and generally used O ring (77) presses the sealing member (72) against the sealed face, so that the sealing member (72) adheres to the sealed face to secure the sealing between the compression mechanism (20) and the coupling member (43) while increase in cost of the compressor is suppressed.

In the tenth invention, the stopper (32*a*) is in contact with the lower end of the upper head (12) fitted in the shell (11) to restrict excessive displacement of the compression mechanism (20) and the motor (30). Hence, the compression mechanism (20) and motor (30), which are elastically supported, are prevented from colliding with the sealed container (10) and from being broken even if great excitation force is exerted in transportation of the compressor, for example.

In the eleventh invention, the opening part of the discharge passage (57) is covered with the stay member (61) used for mounting the compression mechanism (20) to the elastic support member (65) and the gas is discharged from the discharge passage (57) to the space between the lower face of the compression mechanism (20) and the stay member (61). Hence, the refrigerator oil stored in the lower part of the sealed container (10) is prevented from dispersing, which is caused by the gas discharged downward from the discharge passage (57), and in turn, the dispersing refrigerator oil is prevented from flowing into the discharge passage (57).

Furthermore, the discharge gas is discharged once between the lower face of the compression mechanism (20) and the stay member (61). If, for example, the upper muffler (59) is provided above the compression mechanism (20) and the communication hole that allows the space between the compression mechanism (20) and the stay member (61) and the upper muffler (59) to communicate with each other is formed in the compression mechanism (20), the discharge gas discharged in the space between the lower face of the compression mechanism (20) and the stay member (61) is discharged to the upper muffler (59) through the communication hole, thereby mitigating pulsating of the discharge gas and reducing noise of discharge gas which is caused due to the pulsating of the discharge gas. In other words, this invention enables prevention of flow in of the refrigerator oil and reduction in discharge noise by utilizing the stay member (61) necessary for installing the compression mechanism (20). This eliminates the need for providing an additional member such as a muffler for discharge noise reduction and a member for preventing the refrigerator oil from flowing in, thereby reducing the number of components to lead contemplation of cost reduction of the compressor.

In the twelfth invention, the ring member (78) fitted in the outer peripheral groove (71*a*) is pressed against the inner peripheral face of the sealing member (72) by restoring force naturally expanding in the radial direction, so that the gap between the cylindrical portion (71) and the sealing member (72) is sealed. Hence, according to this invention, the sealing member (S) composed of the outer peripheral groove (71*a*) and ring member (78) can seal the cylindrical portion (71) with the sealing member (72) firmly.

In the thirteenth invention, frictional drag is caused between the outer peripheral face of the ring member (78) and the inner peripheral face of the sealing member (72). As described above, the frictional drag is smaller between the metal sealing member (72) and the metal ring member (78) than between the metal sealing member (72) and the rubber O ring. Hence, according to this invention, sliding resistance between the ring member (78) and the sealing member (72) in displacement of the compression mechanism (20) in association with vibration of the compression mechanism (20) can be minimized, making the sealing member (72) to follow displacement of the compression mechanism (20) further reliably. In addition, the degree of freedom in displacement of the compression mechanism (20) is reserved while vibration transferring from the compression mechanism (20) to the sealed container (10) is reduced.

In the fourteenth invention, the differential pressure canceling mechanism (52) is provide for reducing pressing force of the discharge gas towards the intake pipe (42) which works on the compression mechanism (20) in the sealed container (10). Hence, displacement of the compression mechanism (20) and the motor (30) which is due to difference between the discharge gas pressure and the intake gas pressure in the sealed container (10) can be suppressed. In turn, the suppression of the displacement of the compression mechanism (20) and the motor (30) enables setting of the hardness of the support member (65) to an extent that the elastic member (65) can support only the gravity that works on the compression mechanism (20) and the motor (30). As a result, the compression mechanism (20) and the motor (30) are supported softly, thereby suppressing transfer of vibration from the compression mechanism (20) and the motor (30) to the sealed container (10) to reduce noise of the hermetic compressor.

Furthermore, suppression of the displacement of the compression mechanism (20) and the motor (30) eliminates the need for setting a large clearance between the compression mechanism (20) and the motor (30). Thus, the sealed container (10) becomes compact, attaining size reduction of the hermetic compressor.

In the fifteenth invention, the differential pressure canceling mechanism (52) makes the intake gas pressure to work on the outer face of the cylinder (23) in the compression mechanism (20) composed of a rotary fluid machinery. Hence, the intake gas pressure works directly on the cylinder (23) in which the intake passage (40) is formed, so that displacement of the compression mechanism (20) and the motor (30) can be suppressed easily and reliably.

In the sixteenth invention, the differential pressure canceling mechanism (52) makes the intake gas pressure to work on the part on opposite side of the intake passage (40) in the outer face of the cylinder (23). Accordingly, displacement of the compression mechanism (20) and the motor (30) can be suppressed reliably even if the differential pressure canceling mechanism (52) makes the intake gas pressure to Work on only one part of the cylinder (23). Hence, the differential pressure canceling mechanism (52) can be simplified in construction and the cost of the hermetic compressor can be reduced.

In the seventeenth invention, the intake pressure chamber (50) and the communication passage (51) are provided in the differential pressure canceling mechanism (52) to make the intake gas pressure introduced in the intake pressure chamber (50) to work on the cylinder (23). Accordingly, the differential pressure canceling mechanism (52) can be attained with the comparatively simple construction and increase in cost of the hermetic compressor is suppressed which is involved by provision of the differential pressure canceling mechanism (52).

In the eighteenth invention, the communication passage (51) of the differential pressure canceling mechanism (52) is formed in the cylinder (23), thereby eliminating the need for providing an additional member for composing the communication passage (51). Thus, increase in number of components by providing the differential pressure canceling mechanism (52) can be suppressed and the hermetic compressor can be prevented from increasing in size.

In the nineteenth invention, the communication passage (51) formed in the cylinder (23) is utilized so that heat of the high-temperature discharge gas in the sealed container (10) hardly transfers to the compression chamber (22). Thus, the quantity of the heat conducted from the discharge gas in the sealed container (10) to the intake gas in the compression chamber (22) can be reduced, thereby increasing the efficiency of compression performance.

In the twelfth invention, the sealing mechanism (S) forms the low-pressure space (81) in the gap between the outer peripheral face of the compression mechanism (20) and the inner peripheral face of the sealed container (10). The sealed container (10) is in a cylindrical shape and the compression mechanism (20) has a cylindrical outside shape. Namely, the annular gap is formed between the outer peripheral face of the compression mechanism (20) and the inner peripheral face of the sealed container (10). With this gap, the low-pressure space (81) can be formed in the gap between the compression mechanism (20) and the sealed container (10) by the sealing mechanism (S) having a simple construction while the compressor can be free from being complicated.

Moreover, the intake pipe (42) faces the opening part of the intake passage (40) in the outer peripheral face of the compression mechanism (20). Accordingly, if the intake passage (40) is formed so as to pass through the compression mechanism (20) in the radial direction thereof, a path for the intake gas from the intake pipe (42) to the intake passage (40) can be formed straight, thereby preventing increase in pressure loss of the intake gas.

As described above, the low-pressure space (81) is formed at the entire perimeter of the gap between the outer peripheral face of the compression mechanism (20) and the inner peripheral face of the sealed container (10), so that the inner pressure of the low-pressure space (81), that is, the intake gas pressure works on the entire perimeter of the outer peripheral face of the compression mechanism (20). Thus, the uniform gas pressure works in the radial direction of the compression mechanism (20), resulting in no influence of the gas pressure working on the compression mechanism (20). Accordingly, displacement of the compression mechanism (20) towards the intake pipe (42) by the gas pressure is prevented. Also, vibration transferring from the compression mechanism (20) to the sealed container (10) is interrupted further reliably because the compression mechanism (20) is never in contact with the sealed container (10).

In the twenty-first invention, the sealing mechanism (S) is composed of the O rings (79) at the entire perimeter of the outer peripheral face of the compression mechanism (20). Accordingly, the O rings (79) can slide on the inner peripheral face of the sealed container (10) even if the compression mechanism (20) is displaced in association with vibration of the compression mechanism (20), thereby attaining firm sealing of the gap between the compression mechanism (20) and the sealed container (10). In addition, the sealing mechanism (S) can be attained with the simple construction and increase in cost of the compressor can be suppressed which is involved by installation of the sealing mechanism (S).

In the twenty-second invention, the sealing mechanism (S) is composed of the concave grooves (23*c*) formed in the compression mechanism (20) and the ring members (80) fitted therein. The ring members (80) fitted in the concave grooves (23*c*) are pressed against the inner peripheral face of the sealed container (10) by its restoring force expanding naturally in the radial direction, thereby sealing the gap between the compression mechanism (20) and the sealed container (10). Hence, according to this invention, the ring members (80) can slide on the inner peripheral face of the sealed container (10) even if the compression mechanism (20) is displaced in association with vibration of the compression mechanism (20), thereby securing the sealing of the gap between the compression mechanism (20) and the sealed container (10). Further, the sealing mechanism (S) can be attained with the simple construction and increase in cost of the compressor can be suppressed which is involved by installation of the sealing mechanism (S).

In the twenty-third invention, friction drag is caused between the outer peripheral face of the compression mechanism (20) and the inner peripheral face of the sealed container (10). As described above, the friction drag is smaller between the metal sealed container (10) and the metal ring member (80) than between the metal sealed container (10) and a rubber O ring or the like. Hence, according to this invention, sliding resistance between the ring member (80) and the sealed container (10) in displacement of the compression mechanism (20) in association with vibration of the compression mechanism (20) can be minimized and the gap between the compression mechanism (20) and the sealed container (10) can be sealed further firmly.

In the twenty-fourth invention, the oil return passage (29) is formed in the compression mechanism (20). In the sealed container (10), there are many cases where a space filled with the discharge gas faces a space where the refrigerator oil is stored with the compression mechanism (20) interposed. With no oil return passage (29) in the compression mechanism (20), the refrigerator oil separated from the gas would be stored in the space filled with the discharge gas, inviting lubrication failure of the compression mechanism (20) with insufficient refrigerator oil.

In contrast, in this invention, the oil return passage (29) is formed in the compression mechanism (20), so that the refrigerator oil separated from the gas can be introduced into the space where the refrigerator oil is stored through the oil return passage (29). Hence, according to this invention, shortage of the refrigerator oil is prevented even if the sealed container (10) is partitioned so that the refrigerator oil stored in one space is discharged to the other space. Thus, the lubrication failure of the compression mechanism (20) can be prevented. In addition, with the oil return passage (29) formed, the pressure within the sealed container (10) can be kept uniformly.

DETAILED DESCRIPTION OF THE PREFERRED EMBODIMENTS

The embodiments of the present embodiment will described below in detail with reference to the drawings.

Embodiment 1

Figure 1:
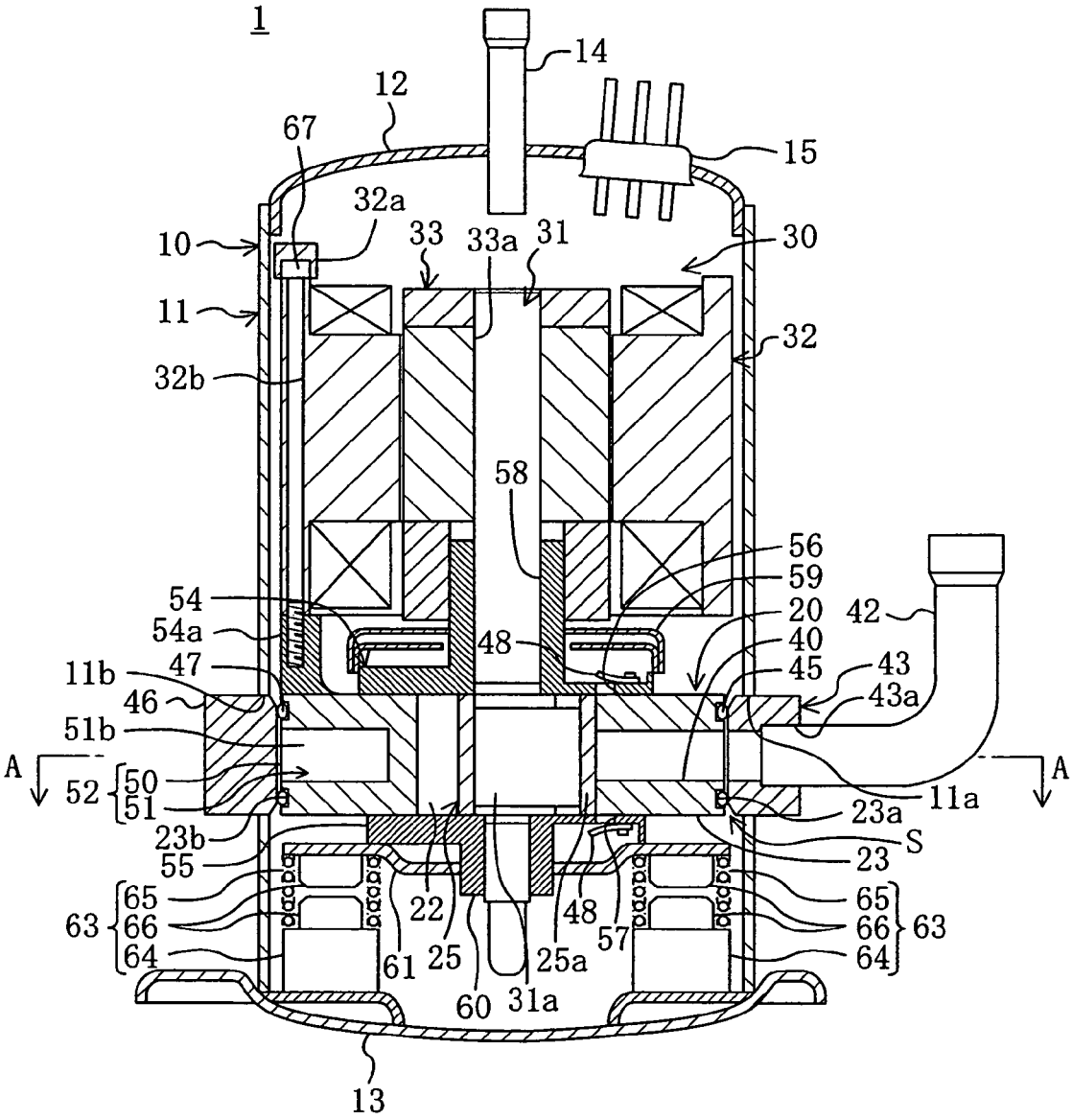
FIG. 1 is a vertical section showing a schematic construction of a rotary compressor according to Embodiment 1.

FIG. 1 relates to Embodiment 1 of the present invention, wherein Embodiment 1 refers to the case where the present invention is applied to a generally-called rocking piston type rotary compressor (1). The compressor (1) performs a refrigerant compression process in a refrigeration cycle of an air conditioner.

In the compressor (1), a sealed container (10) accommodates a compression mechanism (20) and a motor (30). A drive shaft (31) of the compression mechanism (20) is arranged so that the axial direction is vertical. The motor (30) is arranged on the compression mechanism (20) and is connected to the drive shaft (31) of the compression mechanism (20). The motor (30) is integrated with the compression mechanism (20) and the compression mechanism (20) is supported elastically to the sealed container (10) by means of a support mechanism (63).

The sealed container (10) include a shell (11) in a vertically long cylindrical shape, a cap-shaped upper head (12) fitted inside the upper end of the shell (11), and a plate-shaped lower head (13) arranged at the lower end of the shell (11) and being larger than the outer diameter of the shell (11). The entire perimeters of the upper end and the lower end of the shell (11) are welded to the upper head (12) and the lower head (13), respectively, so that the shell (11), the upper head (12), and the lower head (13) are integrated together. The shell (11) of the sealed container (10) has the inner diameter larger than the outer diameter of the compression mechanism (20) and the motor (30) so as not to be in contact with the compression mechanism (20) and the like during operation.

At the substantial center of the upper head (12), a discharge pipe (14) is provided so as to pass vertically through the upper head (12). Further, a terminal (15) for supplying power to the motor (30) is provided at a part apart in the radial direction from the discharge pipe (14) of the upper head (12).

The sealed container (10) includes a coupling member (43) for connecting an intake pipe (42) to an intake passage (40) of the compression mechanism (20), and a block member (46). Wherein, the intake passage (40) will be described later. The coupling member (43) and the block member (46) are in comparatively short cylindrical shapes. Further, the coupling member (43) and the block member (46) have tip end faces located inside the sealed container (10) which are flat faces intersecting substantially at a right angle with the center lines of the coupling member (43) and the block member (46). The outer peripheries of the tip end faces of the coupling member (43) and the block member (46) are chamfered.

As described above, the tip end faces of the coupling member (43) and the block member (46) serve parts of the inner face of the sealed container (10). The tip end face of the coupling member (43) serves as a part of the inner face of the sealed container (10) which faces the peripheral part of the intake passage (40) in the outer face of the compression mechanism (20).

A through hole (43*a*) is formed in the coupling member (43) so that the center line thereof agrees with the center line of the coupling member (43) and so as to open in the tip end face and the base end face of the coupling member (43). The through hole (43*a*) has a diameter at the base end larger than that at the tip end, and one end of the intake pipe (42) is inserted in and fixed to this base end. The block member (46) has a solid shape.

The coupling member (43) and the block member (46) are mounted to the shell (11). Specifically, one coupling side insertion hole (11*a*) for receiving the coupling member (43) and one block side insertion hole (11*b*) for receiving the block member (46) are formed at parts which face each other and are slightly lower than the central portion in the vertical direction of the shell (11). The tip end of the coupling member (43) and the tip end of the block member (46) are inserted in the coupling side insertion hole (11*a*) and the block side insertion hole (11*b*), respectively. The center lines of coupling member (43) and the block member (46) are located on one substantially horizontally extending straight line. Under this condition, the entire perimeters of the outer peripheries of the coupling member (43) and the block member (46) are welded to the perimeters the insertion holes (11*a*, 11*b*) of the shell (11), respectively.

In other words, the coupling member (43) and the block member (46) are arranged at the same level apart at 180° in the peripheral direction from each other in the shell (11). Further, the tip end faces of the coupling member (43) and the block member (46) face each other.

The compression mechanism (20) includes a cylinder (23) substantially formed in a cylindrical shape. A front head (54) for blocking an opening in the upper end face of the cylinder (23) is arranged on the upper part of the cylinder (23). While on the lower part of the cylinder (23), a rear head (55) for blocking an opening in the lower end face of the cylinder (23) is arranged. The front head (54) and the rear head (55) are connected to the cylinder (23) by means of a bolt or the like (not shown) to be integrated. The compression mechanism (20) is arranged so that the center line of the cylinder (23) agrees substantially with the center line of the shell (11).

A rocking piston (25) that rocks by rotation of the drive shaft (31) is inserted in the cylinder (23). A compression chamber (22) surrounded by the outer peripheral face of the rocking piston (25), the inner peripheral face of the cylinder (23), the lower face of the front head (54), and the upper face of the rear head (55) is formed in the cylinder (23)

The rocking piston (25) is an integration of an annular main body (25*a*) and a plate-shaped blade (25*b*) protruding and extending in the radial direction from one part of the outer peripheral face of the main body (25*a*). The blade (25*b*) is interposed between a pair of bushes (27) and is inserted in and supported by an insertion hole (28) formed in an outside part of the compression chamber (22) of the cylinder (23). The blade (25*b*) divides the compression chamber (22) into a low-pressure side and a high-pressure side.

The intake passage (40) is formed in the cylinder (23). One end of the intake passage (40) opens in the inner peripheral face of the cylinder (23) which faces the low-pressure side of the compression chamber (22). The intake passage (40) passes straight through the cylinder (23) from the one end outward in the radial direction. The other end of the intake passage (40) opens in the outer face of the cylinder (23). Further, a discharge port (41) is formed immediately beside the bushes (27) in the cylinder (23). The discharge port (41) is a pair of holes integrated and formed by digging the cylinder (23) from the upper end face and the lower end face.

Moreover, a communication passage (51) is formed in the cylinder (23). This communication passage (51) is composed of an arc-shaped portion (51*a*) and a straight portion (51*b*). The arc-shaped portion (51*a*) extends substantially in a semicircular shape along the inner peripheral face of the cylinder (23) which faces the low-pressure side of the compression mechanism (20). The arc-shaped portion (51*a*) is connected at the base end thereof to the intake passage (40) while the tip end thereof is located on the opposite side of the intake passage (40) in the cylinder (23). On the other hand, the straight portion (51*b*) of the communication passage (51) is formed so as to pass through the cylinder (23) straight from the tip end of the arc-shaped portion (51*b*) outward in the radial direction. The straight portion (51*b*) is arranged so that the center line thereof agrees with the center line of the intake passage (40). Further, the straight portion (51*b*) of the communication passage (51) opens at the tip end thereof in the outer face of the cylinder (23).

In the front head (54) and the rear head (55), head side discharge passages (56, 57) communicating with the discharge port (41) on the cylinder (23) side are formed, respectively, as shown in FIG. 1. Discharge valves (48) for opening/closing the head side discharge passages (56, 57) are provided at the upper end face of the front head (54) and the lower end face of the rear head (55), respectively. The discharge valves (48) are composed of generally-called reed valves. When the discharge valves (48) open, the head side discharge passages (56, 57) communicate with the inner space of the sealed container (10). In other words, the compressor (1) is of generally-called high pressure dome type in which the intake passage (40) of the compression mechanism (20) is connected to the intake pipe (12) and the discharge passages (56, 57) are allowed to communicate with the inner space of the sealed container (10).

A tubular portion (58) protruding upward is formed at the central part of the front head (54). The tubular portion (58) composes a sleeve bearing for supporting the drive shaft (31). A substantially disk-shaped large upper muffler (59) that covers the upper part of the head side discharge passage (56) is fixed to the front head (54). On the other hand, at the central part of the rear head (55), a tubular portion (60) is formed also so as to protrude downward. The tubular portion (60) composes a sleeve bearing for supporting the drive shaft (31). A stay member (61) is mounted to the rear head (55) for fixing the compression mechanism (20) to the lower head (13). The stay member (13) is formed of a plate thicker than the upper muffler (59) and extends outward in the radial direction from the tubular portion (60). The stay member (61) covers the lower part of the head side discharge passage (57).

Furthermore, a communication hole (not shown) allowing a space between the compression mechanism (20) and the stay member (61) and the upper muffler (59) to communicate with each other is formed in the rear head (55), the cylinder (23), and the front head (54).

A plurality (for example, four) of support mechanisms (63) are mounted on the outer peripheral part of the lower face of the stay member (61) with intervals in the peripheral direction left. Each support mechanism (63) includes a base (64) fixed to the lower head (13), a coil spring (65) as an elastic support member fixed to the upper face of the base (64), extending upward, and fixed at the upper end thereof to the lower face of the stay member (61), and a stopper for restricting contraction of the coil spring (65). The coil springs (65) of the support mechanisms support the compression mechanism (20) and the motor (30) so that they are capable of being displaced vertically, that is, in the axial direction of the drive shaft (31).

The compression mechanism (20) is located at almost the same level as the coupling member (43) and the block member (46) which are provided at the sealed container (10). Also, the compression mechanism (20) is set in such a fashion that the opening part of the intake passage (40) in the outer face of the cylinder (23) faces the opening part of the through hole (43*a*) in the tip end face of the coupling member (43) and the opening part of the communication passage (51) in the outer face of the cylinder (23) faces the block member (46). Namely, the opening part of the intake passage (40) in the outer face of the cylinder (23) faces the terminal end of the intake pipe (42) mounted to the coupling member (43).

Figure 2:
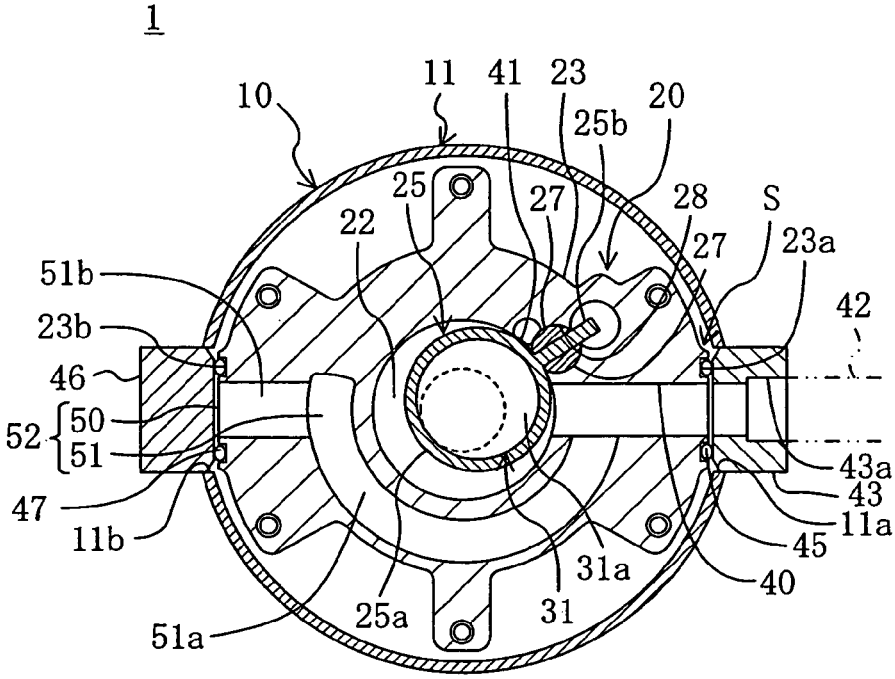
FIG. 2 is a section taken along the line A-A in FIG. 1.
Figure 3:
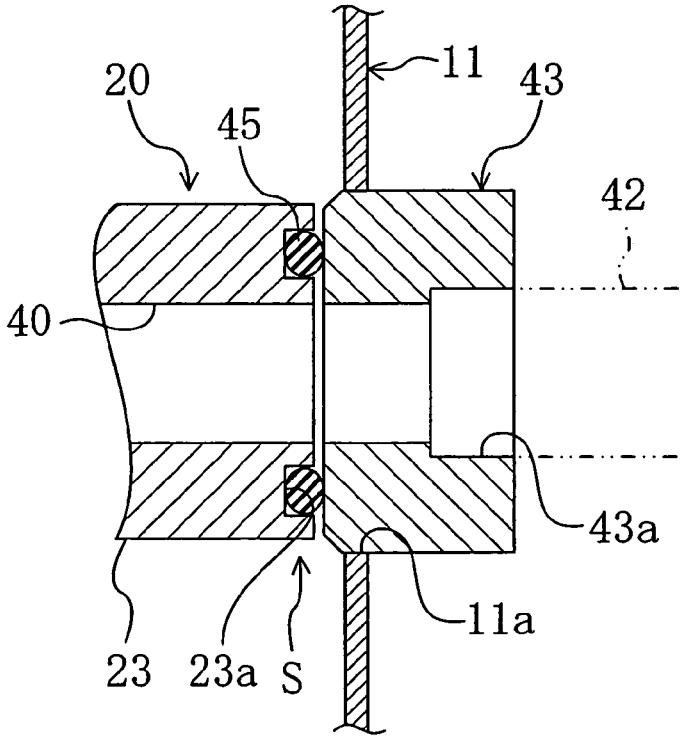
FIG. 3 is a vertical section in enlarged scale of the vicinity of a sealing mechanism.

A part where the intake passage (40) opens in the outer face of the cylinder (23) slightly protrudes outward in the radial direction of the cylinder (23), as shown in FIG. 2. The protruding end face of the slightly protruding portion is a flat face intersecting at a right angle with the radial direction of the cylinder (23) and extends vertically, and the intake passage (40) opens in the protruding end face, as shown in FIG. 3. The protruding end face where the intake passage (40) opens faces the tip end face of the coupling member (43) so that a comparatively narrow gap is formed between these faces. An annular concave groove (23*a*) is formed in the cylinder (23) so as to surround the opening part of the intake passage (40) in the protruding end face. This concave groove (23*a*) is formed by digging the peripheral part in a ring shape around the opening part of the intake passage (40) in the outer face of the cylinder (23).

In the concave groove (23*a*), an O ring (45) is fitted. The O ring (45) has a diameter lager than the opening part of the intake passage (40) of the cylinder (23) and the through hole (43*a*) of the coupling member (43). The thickness of the O ring (45) is set so that the O ring (45) adheres to both the bottom face of the concave groove (23*a*) of the cylinder (23) and the tip end face of the coupling member (43) and is crushed between the cylinder (23) and the coupling member (43). Crashing the O ring (45) in advance keeps the O ring (45) adhering to both the cylinder (23) and the coupling member (43) even when the cylinder (23) is displaced in a direction away from the coupling member (43) in the operation.

The gap between the outer face of the cylinder (23) and the tip end face of the coupling member (43) is sealed by means of the O ring (45) to keep hermeticity of a path from the intake pipe (42) to the intake passage (40). Namely, in the present embodiment, the tip end face of the coupling member (43) serves as a sealed face and the O ring (45) pressed against the sealed face serves as a sealing member. Further, the concave groove (23*a*) formed in the cylinder (23) and the O ring (45) fitted therein compose a sealing mechanism (S) for sealing the gap between the cylinder (23) and the coupling member (43) to connect the intake pipe (42) and the intake passage (40) with each other.

A part of the outer face of the cylinder (23) where the straight portion (51*b*) of the communication passage (51) opens slightly protrudes outward in the radial direction of the cylinder (23), as shown in FIG. 2. The protruding end face of the slightly protruding portion is a flat face intersecting at a right angle with the radial direction of the cylinder (23) and the communication passage (51) opens in this protruding end face. The protruding end face where the communication passage (51) opens faces the tip end face of the block member (46) and a comparatively narrow gap is formed between these faces. Further, a concave groove (23*b*) is formed in the cylinder (23) so as to surround the opening part of the communication passage (51) in the protruding end face. The concave groove (23*b*) is formed by digging the peripheral part in a ring shape around the opening part of the communication passage (51) in the outer face of the cylinder (23).

In the concave groove (23*b*), an O ring (47) is fitted. The diameter of the O ring (47) is larger than the straight portion (51*b*) of the communication passage (51) and is equal to that of the O ring (45) provided on the intake passage (40) side. The thickness of the O ring (47) is set so that the O ring (47) adheres to both the bottom face of the concave groove (23*b*) of the cylinder (23) and the tip end face of the block member (46) and is crushed between the cylinder (23) and the block member (46). The O ring (45) is kept adhering to both the cylinder (23) and the block member (46) even when the cylinder (23) is displaced in the operation.

In the gap between the cylinder (23) and the block member (46), a part further inside than the O ring (47) serves as an intake pressure chamber (50) of which periphery is partitioned. The intake pressure chamber (50) is separated from the inner space of the sealed container (10) filled with discharge gas and communicates with the intake passage (40) through the communication passage (51). The hermeticity of the intake pressure chamber (50) is kept by the O ring (47) adhering to the cylinder (23) and the block member (46). The intake pressure chamber (50) and the communication passage (51) compose a differential pressure canceling mechanism (52).

Referring to the motor (30), a brushless DC motor is employed. The DC motor uses a thin electromagnetic steel plate having a thickness of, for example, 0.2 mm for increasing the motor efficiency. As shown in FIG. 1, the motor (30) includes a cylindrical stator (32) fixed to the front head (54) of the compression mechanism (20) and a rotor (33) rotatably arranged within the stator (32). The drive shaft (31) is inserted in a center hole (33*a*) of the rotor (33) to be fixed to the rotor (33).

The drive shaft (31) is arranged so that the center line thereof agrees with the center line of the cylinder (23). An eccentric portion (31*a*) is formed in the lower end part of the drive shaft (31). The eccentric portion (31*a*) has a diameter larger than the other parts of the drive shaft (31) and the center line thereof is eccentric with respect to the axial center of the drive shaft (31). The drive shaft (31) passes through the main body (25*a*) of the rocking piston (25) provided in the cylinder (23), and the eccentric portion (32*a*) rocks at the outer peripheral face thereof with respect to the inner peripheral face of the main body (25*a*). Thus, the rocking piston (25) can be broadly referred to as a rocking member or orbiting member that extends along the rotation axis of the drive shaft (31) to move between opposing (stationary) axially facing surfaces of the front and rear heads (54) and (55) that define axial ends of the compression chamber (20).

A plurality of protrusions (32*a*) are provided at the outer peripheral part of the stator (32) close to the lower end of the upper head (12) with intervals left in the peripheral direction. Through holes (32*b*) passing vertically are formed in parts corresponding to the protrusions (32*a*) in the stator (32). On the other hand, bosses (54*a*) corresponding to the through holes (32*b*) of the stator (32) are formed in the upper part of the front head (54) of the compression mechanism (20). The bolts (67) are inserted in the through holes (32*b*) so as to be connected to the bosses (54*a*) of the front head (54), thereby fixing and integrating the stator (32) to the front head (54).

The protrusions (32*a*) of the stator (32) serve stoppers for restricting upward displacement of the compression mechanism (20) and the motor (30). In detail, when great excitation force is exerted on the compression mechanism (20) or the motor (30) in transportation of the compressor (1), for example, the protrusions (32*a*) are in contact with the lower end of the upper head (12) to prevent excessive displacement of the compression mechanism (20) and the motor (30).

In the compressor (1) constructed as above, when the rocking piston (25) rocks upon start of the motor (30), the intake gas in the intake pipe (42) flows into the intake passage (40). The intake gas flowing in the intake passage (40) is sucked into the compression chamber (22).

In the above compressor (1), the intake passage (40) extends straight in the radial direction of the cylinder (23) and has a comparatively short length. Accordingly, the intake gas from the intake pipe (42) is sucked to the compression chamber (22) through the straight and short intake passage (40). Therefore, pressure loss of the gas flowing from the intake passage (40) until it is sucked to the compression chamber (22) is minimized compared with that of the gas flowing in a curved intake passage. Further, the gas density at flowing into the compression chamber (22) is prevented from lowering, thereby increasing the efficiency of the compressor (1).

The intake gas sucked in the compression chamber (22) is compressed by the rocking piston (25) and passes through the discharge port (41) on the cylinder (23) side and the head side discharge passages (56, 57) in this order. At that time, the discharge valves (48) open by the discharge gas pressure, so that compressed gas refrigerant in the compression chamber (22) is discharged as discharge gas into the sealed container (10).

The sealed container (10) is filled with the discharge gas from the compression mechanism (20) to be at high pressure. Then, the discharge gas from the head side discharge passage (56) is discharged into the upper muffler (59) first, and then, flows outside the upper muffler (59). On the other hand, the discharge gas from the lower head side discharge passage (57) is discharged inside the stay member (61), is lead to the upper muffler (59) through the communication hole formed in the rear head (55), the cylinder (23), and the front head (54), and then, flows outside the upper muffler (59). Whereby pulsating of the discharge gas is mitigated and discharge noise is reduced. Then, the discharge gas flows into the space above the motor (30) in the sealed container (10) to be lead outside the sealed container (10) through the discharge pipe (14).

In the above compressor (1), the lower part of the head side discharge passage (57) formed in the rear head (55) is covered with the stay member (61), thereby preventing the refrigerator oil stored in the lower part of the sealed container (10) from flowing into the head side discharge passage (56). This eliminates the need for providing an additional member at the lower part of the compression mechanism (20), such as a muffler for discharge noise reduction or a member for preventing the refrigerator oil from flowing in, thereby reducing the number of components to lead to contemplation of compaction and cost reduction of the compressor (1).

Operation and Effects of Embodiment 1

During the operation of the compressor (1), there occur vibration caused due to torque variation in association with compression work of the compression mechanism (20) and vibration of the motor (30) to cause vibration of the compression mechanism (20) and the motor (30). In the compressor (1), the coil springs (65) support the compression mechanism (20) and the motor (30), so that the vibrations occurring in the compression mechanism (20) and the motor (30) are absorbed by the coil springs (65). Thus, vibration transferring from the compression mechanism (20) and the motor (30) to the sealed container (10) are reduced.

Further, the compression mechanism (20) is supported to the bottom of the sealed container (10) through the plurality of coil springs (65), so that the cylinder (23) of the compression mechanism (20) is displaced with respect to the coupling member (43) and the block member (46) when vibration occurs in the compression mechanism (20) or the motor (30) in the operation of the compressor (1). The outer face of the cylinder (23) is a flat face along the axial direction of the drive shaft (31) and extends in parallel with the tip end face of the coupling member (43). Accordingly, when the cylinder (23) is displaced in the operation of the compressor (1), the O ring (45) fitted in the concave groove (23*a*) of the cylinder (23) slides on the tip end face of the coupling member (43) while sealing the cylinder (23) with the coupling member (43) without preventing the displacement of the compression mechanism (20).

Moreover, the O ring (47) fitted in the concave groove (23*b*) of the cylinder (23) slides on the tip end face of the block member (46) while sealing the cylinder (23) with the block member (46) without preventing the displacement of the compression mechanism (20). Further, when the cylinder (23) is displaced in a direction perpendicular to the tip end face of the coupling member (43) or the block member (46), the O ring (45 or 47) is deformed in response to the displacement of the cylinder (23), thereby reserving the sealing between the cylinder (23) and the coupling member (43) or the block member (46).

As described above, according to the present embodiment, even in the case where the intake passage (40) is formed so as to pass through the cylinder (23) in the radial direction, the sealing between the cylinder (23) and the coupling member (43) can be secured without preventing displacement of the compression mechanism (20) in the operation of the compressor (1). In other words, the sealing mechanism (S) seals the cylinder (23) with the coupling member (43) firmly while increase in pressure loss of the gas sucked in the intake passage (40) is avoided by forming the intake passage (40) straight and comparatively short. Further, the degree of freedom in displacement of the compression chamber (20) is reserved, so that vibration transferring from the compression mechanism (20) to the sealed container (10) can be reduced.

Furthermore, the sealing mechanism (S) is composed such that the concave groove (23*a*) is formed in the cylinder (23) and the sealing member (45) is fitted in the concave groove (23*a*). This simplifies the construction of the sealing mechanism (S). In addition, the sealing member of the sealing mechanism (S) becomes cheep because the O ring (45) is widely and generally used as a sealing member. Thus, increase in cost of the compressor (1) which is involved by installation of the sealing mechanism (S) can be suppressed.

Moreover, the opening part of the discharge passage (57) is covered with the stay member (61) used for mounting the compression mechanism (20) to the coil springs (65) so that the gas is discharged from the discharge passage (57) to the space between the lower face of the compression mechanism (20) and the stay member (61). Accordingly, dispersion of the refrigerator oil that the lower part of the sealed container (10) stores by the gas discharged downward from the discharge passage (57) is prevented and the dispersed refrigerator oil is obviated from flowing into the discharge passage (57).

Further, the discharge gas is discharged once between the lower face of the compression mechanism (20) and the stay member (61), and then, flows outside the stay member (61). This mitigates pulsating of the discharge gas, thereby reducing discharge noise caused due to the pulsating of the discharge gas. Namely, the stay member (61), which is necessary for installation of the compression mechanism (20), is utilized for preventing the refrigerant oil from flowing in and for reducing the discharge noise. This eliminates the need for providing an additional member such as a muffler for discharge noise reduction and a member for preventing the refrigerator oil from flowing in, reducing the number of components to lead to contemplation of cost reduction and compaction of the compressor (1).

Moreover, the lower end of the upper head (12) mounted to the shell (11) is located inside the inner peripheral face of the shell (11). When the compression mechanism (20) and the motor (30) are displaced upward by a predetermined amount, the protrusions (32*a*) are in contact with the lower end of the upper head (12), thereby restricting the upward displacement of the compression mechanism (20) and the motor (30). Namely, excessive displacement of the compression mechanism (20) and the motor (30) is restricted by allowing the protrusions (32*a*) to be in contact with the lower end of the upper head (12). Accordingly, the compression mechanism (20) and the motor (30) which are elastically supported by the coil springs (65) are prevented from colliding with the sealed container (10) and from being broken when great excitation force is exerted on the compression mechanism (20) or the motor (30) in transportation of the compressor (1).

Furthermore, because the compressor (1) is of high pressure dome type, the high-pressure discharge gas pressure within the sealed container (10) works uniformly on the compression mechanism (20) and the motor (30). On the other hand, the low-pressure intake gas is introduced through the intake pipe (42) into the intake passage (40) of the cylinder (23) in the compression mechanism (20). Accordingly, the intake gas pressure works on a region further inside than the O ring (45) on the intake passage (40) side in the compressor (1). Further, the compressor (1) is provided with the differential pressure canceling mechanism (52) and the intake gas pressure of the intake passage (40) is introduced into the intake pressure chamber (50) through the communication passage (51) of the cylinder (23). Accordingly, the intake gas pressure works also on a region further inside than the O ring (47) on the opposite side of the intake passage (40) of the cylinder (23).

Specifically, the discharge gas pressure within the sealed container (10) works on the entirety of the compression mechanism (20) while the intake gas pressure works on the regions having the same area on the intake passage (40) side and the opposite side of the intake passage (40) side in the reverse directions to each other in the cylinder (23) of the compression mechanism (20). Thus, forces of the discharge gas pressure and the intake gas pressure which work on the compression mechanism (20), cancel each other totally, so that pressing force working on the compression mechanism (20) towards the intake passage (40) becomes nearly zero.

As a result, the coil springs (65) do not receives force towards the compression mechanism (20) which is caused due to difference between the discharge gas pressure and the intake gas pressure, enabling the spring constant of the coil springs (65) to be set to a small value to an extent that the coil springs (65) can support only the gravity working on the compression mechanism (20) and the motor (30). Hence, the coil springs (65) can be set to be soft, so that vibration of the compression mechanism (20) and the motor (30) become harder to transfer, reducing noise of the compressor (1) sufficiently.

The differential pressure canceling mechanism (52) reduces the pressing force working on the compression mechanism (20) towards the intake pipe (42), suppressing displacement of the compression mechanism (20) and the motor (30). As a result, clearances between the compression mechanism (20) and the like and the inner face of the sealed container (10) can be minimized. The minimization of the clearance attains compaction of the sealed container (10), resulting in compaction of the compressor (1).

Further, the intake gas pressure works also on the opposite side of the intake passage (40) in the outer face of the cylinder (23). Accordingly, if the differential pressure canceling mechanism (52) is composed so that the intake gas pressure works on only one part of the outer face of the cylinder (23), the pressing force towards the intake pipe (42) is reduced stably. This simplifies the construction of the differential pressure canceling mechanism (52), reducing the cost of the compressor (1). In addition, the differential pressure canceling mechanism (52) makes the intake gas pressure to work directly on the outer face of the cylinder (23), thereby suppressing displacement of the compression mechanism (20) and the motor (30) easily and reliably.

Moreover, the intake pressure chamber (50) is formed between the tip end face of the block member (46) and the outer face of the cylinder (23) and the intake gas pressure introduced from the communication passage (51) is made to work on the outer face of the cylinder (23). This attains a comparatively simple construction of the differential pressure canceling mechanism (52), thereby suppressing increase in cost of the compressor (1) which is involved by provision of the differential pressure canceling mechanism (52). Further, changing the area of the outer face of the cylinder which composes the intake pressure chamber (50) enables change in force to the cylinder (23) by the differential pressure canceling mechanism (52).

Furthermore, the communication passage (51) of the differential pressure canceling mechanism (52) is formed in the cylinder (12), eliminating the need for providing an additional member for the communication passage (51). This suppresses increase in number of components and prevents increase in size of the compressor (1).

Further, the communication passage (51) is formed so as to extend along the inner periphery of the compression chamber (22) on the low-pressure side of the cylinder (23), forming the space between the outer face of the cylinder (23) and the compression chamber (22). This communication passage (51) inhibits heat conduction from the outer face to the inner peripheral face of the cylinder (23). As a result, the heat of the high-pressure discharge gas discharged in the sealed container (10) becomes hard to transfer to the compression chamber (22). Thus, the intake gas sucked in the compression chamber (22) is prevented from being heated, increasing the efficiency of the compressor (1).

It is note that the differential pressure canceling mechanism (52) makes the intake gas pressure to work on only one part of the cylinder (23) in Embodiment 1 but the present invention is not limited thereto. The intake gas pressure may work on a plurality of parts of the cylinder (23), through not shown. Specifically, in the case where the differential pressure canceling mechanism (52) makes the intake gas pressure to work on two parts of the outer face of the cylinder (23), intake pressure chambers similar to the intake pressure chamber in Embodiment 1 are formed at regular intervals left in the peripheral direction of the cylinder (23), namely, at 120° intervals with the part where the intake passage (40) of the cylinder (23) is formed as a start point. Then, a plurality of communication passages for allowing the intake passage (40) to communicate with the intake pressure chambers are formed in the cylinder (23).

Similarly, in the case where the differential pressure canceling mechanism (52) makes the intake gas pressure to work on three parts of the outer face of the cylinder (23), the intake pressure chambers are formed at regular 90° intervals. If the intake gas pressure is made to work on the outer face of the cylinder (23) at regular intervals in this way, the pressing force working on the compression mechanism (20) can be reduced reliably.

Furthermore, it is noted that only one intake pipe (42) is provided in Embodiment 1 but two intake pipes may be provided. In this case, a second block member (46) having the same construction as the block member (46) to serve as a first block member is provided. One end of an auxiliary intake pipe, which has the same construction as the intake pipe (42), is inserted in the through hole of the second block member (46). This auxiliary intake pipe communicates with the intake passage (40) through the communication passage (51), so that the two of the intake pipe (42) and the auxiliary intake pipe suck the intake gas to the compression chamber (22). As a result, the flow rate of the intake gas in the intake pipe (42) and the auxiliary intake pipe lowers. Thus, the pressure loss of the intake gas at suction thereof to the compression chamber (22) can be reduced and the efficiency of the compressor (1) can be increased. In addition, in the case where two or more intake pressure chambers are provided, the number of intake pipes may be increased correspondingly.

Modified Example 1 of Embodiment 1

Figure 4:
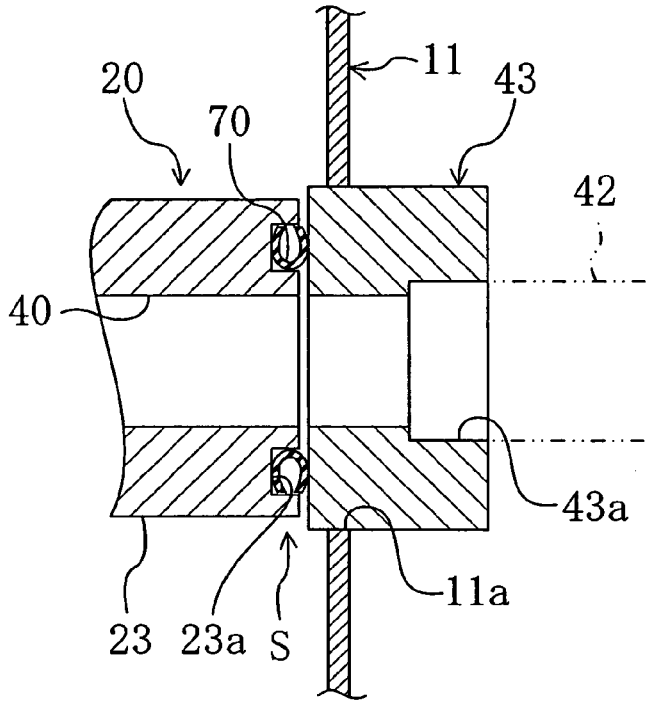
FIG. 4 is a view corresponding to FIG. 3 according to Modified Example 1 of Embodiment 1.

The O rings are used as the sealing member in Embodiment 1, but hallow sealing members (70) in a U-shape or a horseshoe shape in section, which opens to outer periphery of the sealing member, may be employed rather than the O rings, as shown in FIG. 4. FIG. 4 is an enlarged view of the vicinity of the coupling member (43) in FIG. 1, wherein only the sealing member (70) fitted in the concave groove (23*a*) on the intake passage (40) side of the cylinder (23) is shown but the same sealing member (70) is fitted also in the concave groove (23*b*) on the communication passage (51) side of the cylinder (23) in the present modified example.

In this case, a part of the sealing member (70) between a part in contact with the bottom face of the concave groove (23*a*) of the cylinder (23) and a part in contact with the tip end face of the coupling member (43) is hollow, so that the sealing member (70) is deformed in the thickness direction by less force. When the compression mechanism (20) is displaced in a direction perpendicular to the tip end face of the coupling member (43), the distance between the outer face of the cylinder (23) and the tip end face of the coupling member (43*b*) changes. The sealing member (70) is easily deformed correspondingly to the change in distance. Accordingly, the sealing member (70) is kept to be in contact with both the bottom face of the concave groove (23*a*) of the cylinder (23) and the tip end face of the coupling member (43), sealing the gap between the cylinder (23) and the coupling member (43) firmly.

Further, in the present modified example, the sealing member (70) is deformed in the thickness direction by less force, so that vibration of the cylinder (23) in a direction perpendicular to the tip end face of the coupling member (43) is hard to transfer to the sealed container (10), attaining further noise reduction.

Modified Example 2 of Embodiment 1

Figure 5:
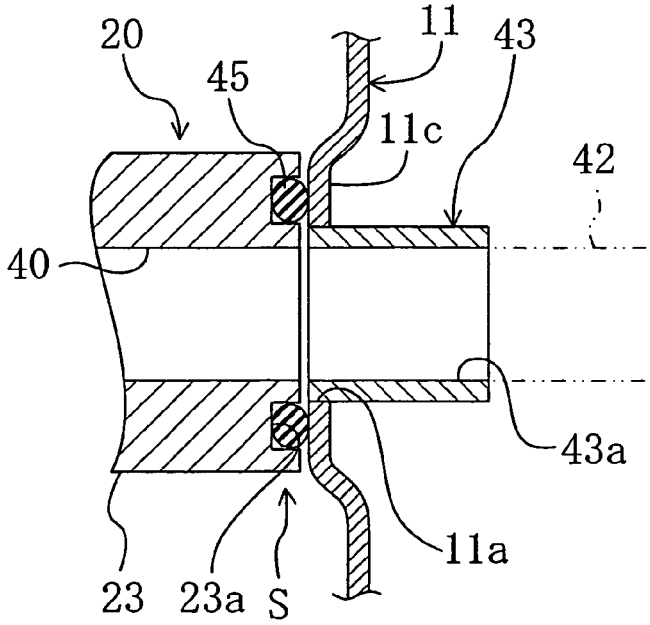
FIG. 5 is a view corresponding to FIG. 3 according to Modified Example 2 of Embodiment 1.

The tip end face of the coupling member (43) serves as the sealed face in Embodiment 1, but the inner face of the shell (11) may serve as the sealed face, as shown in FIG. 5. In this modified example, a concave portion (11*c*) recessed inwardly is formed in a part of the shell (11) which faces the peripheral part of the intake passage (40) in the outer face of the cylinder (23). A coupling side insertion hole (11*a*) is formed in the central part of the concave portion (11*c*). The intake pipe (42) is fixed to the shell (11) by means of the coupling member (43) inserted in the coupling side insertion hole (11*a*).

The concave portion (11*c*) is in a circular shape in section and has a flat face as the inner peripheral face of the shell (11) which is in parallel with the axial direction of the drive shaft (31). Further, the coupling member (43) in this modified example is in a thinner cylindrical shape than that in the above embodiment and the base end of the through hole (43*a*) of the coupling member (43) receives one end of the intake pipe (42). The tip end of the coupling member (43) is inserted in the coupling side insertion hole (11*a*) and the entire perimeter of the outer peripheral face of the coupling member (43) is welded to the periphery of the coupling side insertion hole (11*a*).

In the present modified example, though not shown, it is possible that a concave portion similar to the above concave portion (11*c*) is formed in a part of the shell (11) which faces the peripheral part of the communication passage (51) of the cylinder (23) and the O ring (47) adheres to the concave portion.

Embodiment 2

Figure 6:
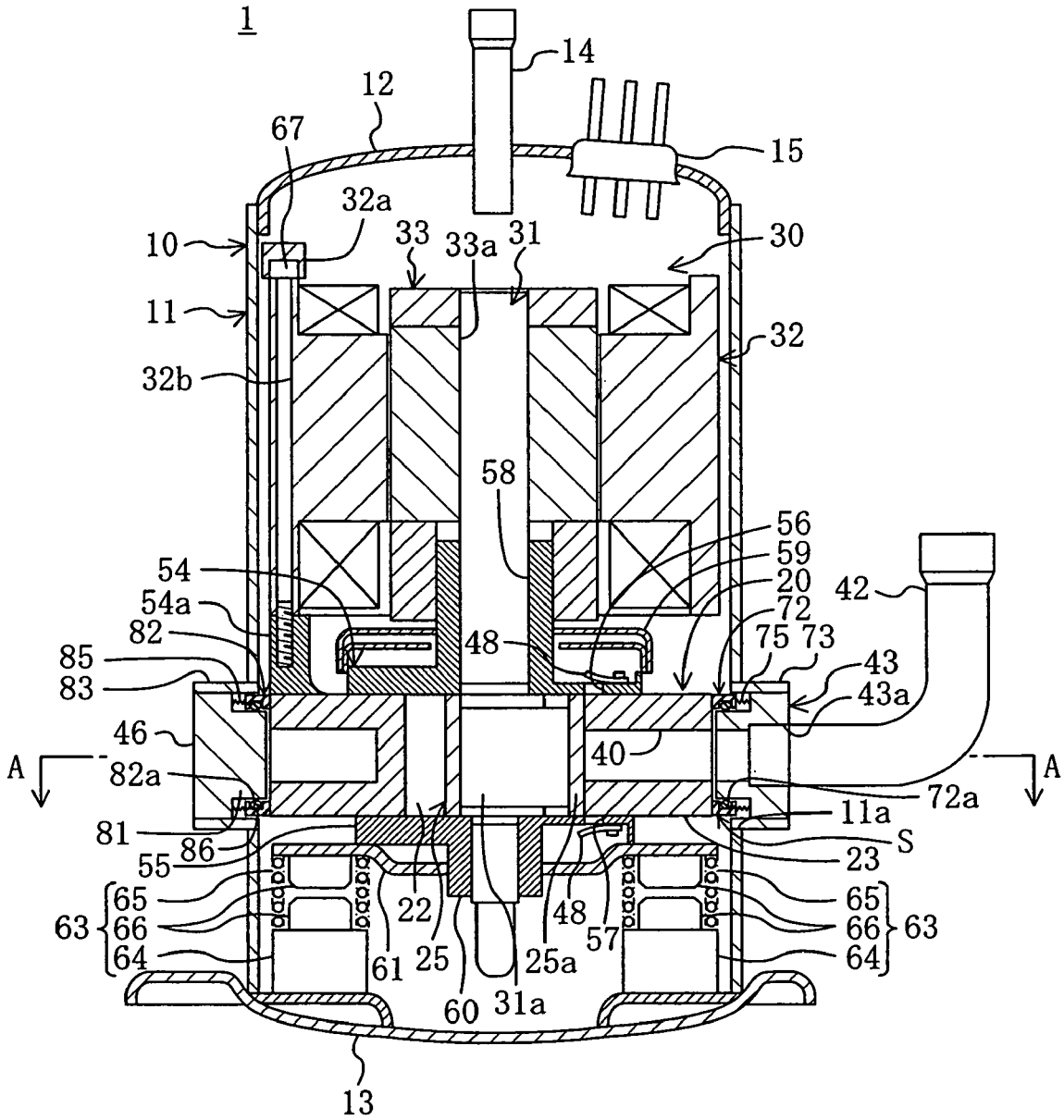
FIG. 6 is a view corresponding to FIG. 1 according to Embodiment 2.

FIG. 6 shows a rotary compressor according to Embodiment 2 of the present invention. The rotary compressor of the present embodiment is the same as that of Embodiment 1, except the sealing mechanism (S), the coupling member (43), and the block member (46). The same reference numerals are assigned to the same members as in Embodiment 1 in the following description and only the different features are described in detail.

Figure 7:
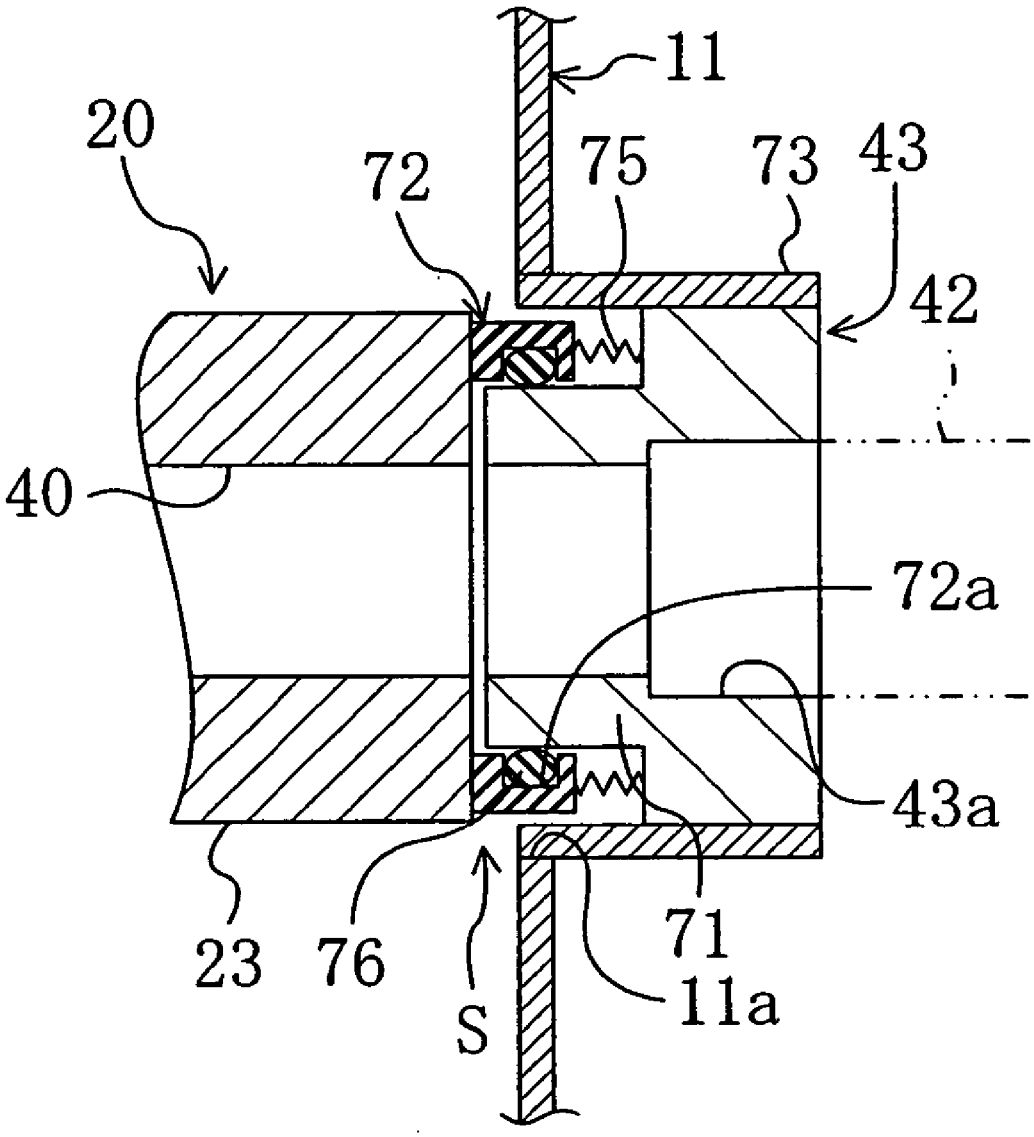
FIG. 7 is a view corresponding to FIG. 3 according to Embodiment 2.

In the present embodiment, as shown in FIG. 7, the peripheral portion of the intake passage (40) in the outer face of the cylinder (23) is a flat face that intersects substantially at a right angle with the radial direction of the cylinder (2) and serves as the sealed face. On the other hand, the tip end of the coupling member (43) is formed in a cylindrical shape so as to compose a cylindrical portion (71). A sealing member (72) is freely fitted to the cylindrical portion (71) and is pressed against the sealed face.

Specifically, a cylindrical member (73) in a comparatively short tubular shape is inserted in the coupling side insertion hole (11*a*) of the shell (11) and the coupling member (43) is inserted in the cylindrical member (73). The cylindrical portion (71) of the coupling member (43) is formed so that the center line thereof agrees with the center line of the coupling member (43). The outer diameter of the cylindrical portion (71) is smaller than the outer diameter of the base end of the coupling member (43). The cylindrical member (73) adheres to the entire outer peripheral face of the base end part of the coupling member (43), and the length of the cylindrical member (73) in the axial direction is substantially equal to the length of the coupling member (43) in the axial direction. The entire perimeter of the tip end of the cylindrical member (73) is welded to the coupling side insertion hole (11*a*) of the sealed container (10).

The sealing member (72) is formed in a ring shape rectangular in section. Namely, the sealing member (72) is formed in a comparatively short cylindrical shape extending in the axial direction of the coupling member (43). The inner diameter of the sealing member (72) is slightly larger than the outer diameter of the cylindrical portion (71). An inner peripheral groove (72*a*) is formed around the entire perimeter of the inner peripheral face of the sealing member (72). An O ring (76) is fitted in this inner peripheral groove (72*a*). The O ring (72) is in contact at the inner peripheral face thereof with the outer peripheral face of the cylindrical portion (71).

Between the base end face of the sealing member (72), which is on the coupling member (43) side, and the coupling member (43), a spring (75) is provided so as to expand or contract in the axial direction of the coupling member (43). The force of the spring (75) towards the cylinder (23) works on the sealing member (72). Upon receipt of the force from the spring (75), the tip end face of the sealing member (72) is pressed against the sealed face of the outer face of the cylinder (23).

In the present embodiment, the sealing member (72) is freely fitted to the cylindrical portion (71) with the O ring (76) fitted in the inner peripheral groove (72*a*) of the sealing member (72). Accordingly, the outer peripheral face of the O ring (76) adheres to the bottom face of the inner peripheral groove (72*a*) of the sealing member (72*b*) while the inner peripheral face of the O ring (76) adheres to the outer peripheral face of the cylindrical portion (71). Thus, the O ring (76) can seal the inner peripheral face of the sealing member (72) with the outer peripheral face of the cylindrical portion (71).

Further, the sealing member (71) is pressed against the sealed face of the outer face of the cylinder (23) by the spring (75). Therefore, the tip end face of the sealing member (72) is kept adhering to the sealed face even if the cylinder (23) is displaced in association with vibration of the compression mechanism (20). Thus, the sealing between the cylinder (23) and the coupling member (43) is secured further.

Moreover, in the present embodiment, the O ring (76) fitted in the inner peripheral groove (72*a*) of the sealing member (72) seals the inner peripheral face of the sealing member (72) with the outer peripheral face of the cylindrical portion (71), so that the sealing between the sealing member (72) and cylindrical portion (71) is secured and the gap between the inner peripheral face of the sealing member (72) and the outer peripheral face of the cylindrical portion (71) can be set wide. With the wide gap between the inner peripheral face of the sealing member (72) and the outer peripheral face of the cylindrical portion (71), the space between the compression mechanism (20) being displaced during the operation and the sealed container (10) can be sealed further firmly.

Figure 8:
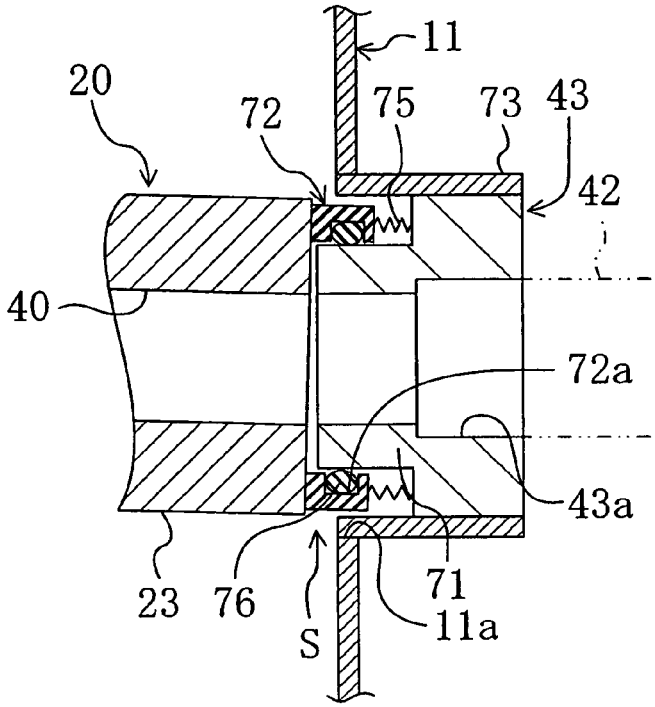
FIG. 8 is a view corresponding to FIG. 3 which shows a state in which a cylinder is displaced by vibration of a compression mechanism.

The above point of view will be described with reference to FIG. 8. During the operation of the compressor (1), the compression mechanism (20) may vibrate to be displaced with inclination of the outer face of the cylinder (23) with respect to the inner face of the sealed container (10). In order to secure the sealing between the compression mechanism (20) and the sealed container (10) in such a case, it is preferable to make the entirety of the tip end face of the sealing member (72) to adhere to the outer face of the cylinder (23) by inclining the sealing member (72). If the space between the inner peripheral face of the sealing member (72) and the outer peripheral face of the cylindrical portion (71) is set wide, the inner peripheral face of the sealing member (72) is out of contact with the outer peripheral face of the cylindrical portion (71) even if the sealing member (72) inclines due to displacement of the compression mechanism (20).

Hence, the sealing member (72) can surely follow displacement of the compression mechanism (20), keeping the tip end face of the sealing member (72) adhering to the outer face of the cylinder (23) to attain firm sealing between the compression mechanism (20) and the sealed container (10). Further, vibration transferring from the compression mechanism (20) to the sealed container (10) through the sealing member (72) can be reduced by the ensured following of the sealing member (72) to displacement of the compression mechanism (20).

It is noted that the block member (46) is constituted likewise the coupling member (43) in Embodiment 2. As shown in FIG. 6, a cylindrical member (83) is inserted in the block side insertion hole (11*b*) of the shell (11) and the block member (46) is inserted in the cylindrical member (83). A sealing member (82) is formed in a ring shape rectangular in section, and a spring (85) is provided between the base end face of the sealing member (82), which is on the block member (46) side, and the block member (46). The force of the spring (85) towards the cylinder (23) works on the sealing member (82). Upon receipt of the force from the spring (85), the sealing member (82) is pressed against the outer face of the cylinder (23).

Modified Embodiment 1 of Embodiment 2

Figure 9:
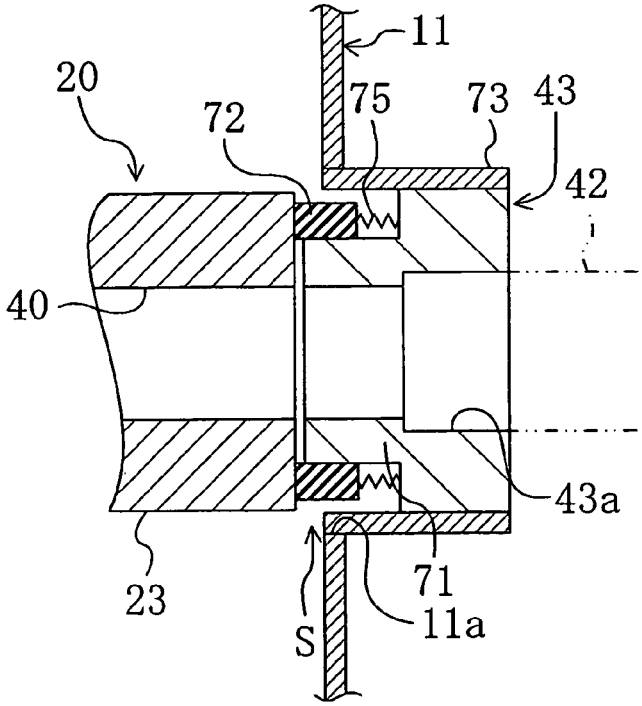
FIG. 9 is a view corresponding to FIG. 3 according to Modified Example 1 of Embodiment 2.

The O ring (76) is fitted in the inner peripheral groove (72*a*) formed in the sealing member (72) in Embodiment 2, but it is possible, as shown in FIG. 9, that the O ring (76) is dispensed with, the sealing member (72) is formed in a simple cylindrical shape, and the entire inner peripheral face of the sealing member (72) slides on the outer peripheral face of the cylindrical portion (71). Specifically, the inner diameter of the sealing member (72) is set slightly larger than the outer diameter of the cylindrical portion (71) so as to form little or no gap between the inner peripheral face of the sealing member (72) and the outer peripheral face of the cylindrical portion (71). This prevents the gas flowing from the intake pipe (42) to the intake passage (40) from leaking between the inner peripheral face of the sealing member (72) and the outer peripheral face of the cylindrical portion (71) even without the O ring (76) provided at the inner periphery of the cylindrical portion (71), thereby contemplating simplification of the sealing mechanism (S) while ensuring the sealing ability. Wherein, FIG. 9 shows only the sealing member (72) fitted to the cylinder (23) on the intake passage (40) side. Another sealing member (72)

is fitted to the cylinder (23) on the communication passage (51) side in the present embodiment, as well.

Modified Example 2 of Embodiment 2

Figure 10:
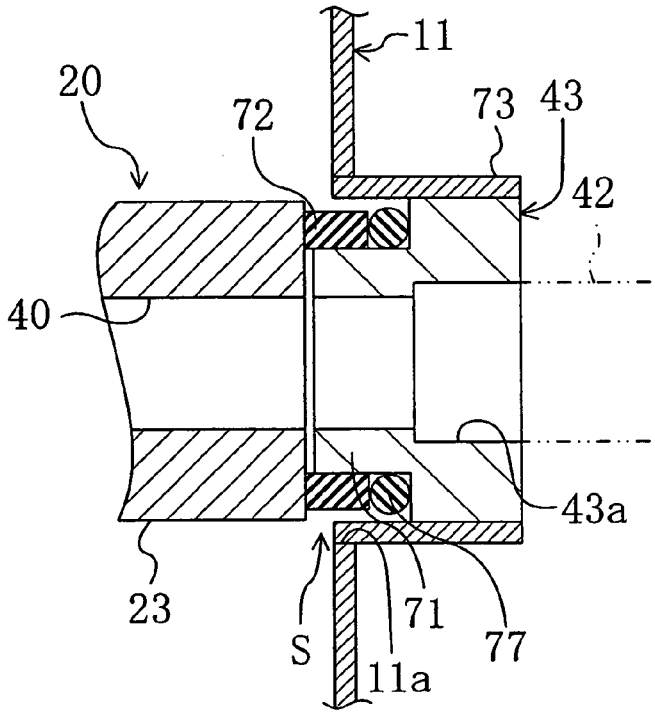
FIG. 10 is a view corresponding to FIG. 3 according to Modified Example 2 of Embodiment 2.

The sealing member (72) is pressed against the outer face of the cylinder (23) by the spring (75) in Embodiment 2, but may be pressed by an O ring (77) rather than the spring (15), as shown in FIG. 10. In this case, the sealing member (72) is pressed against the sealed face of the outer face of the cylinder (23) by restoring force caused upon elastic deformation of the O ring (77) in a direction where it is crushed.

Further, the O ring (77) adheres to both the base end face of the sealing member (72) and the coupling member (43). Accordingly, the O ring (77) is utilized as a pressing member for sealing the sealing member (72) with the coupling member (43).

Hence, the sealing member (72) can adhere to the sealed face by means of the widely and generally used O ring (77). As a result, the sealing between the cylinder (23) and the coupling member (43) is secured while increase in cost of the compressor (1) is suppressed.

Modified Example 3 of Embodiment 2

Figure 11:
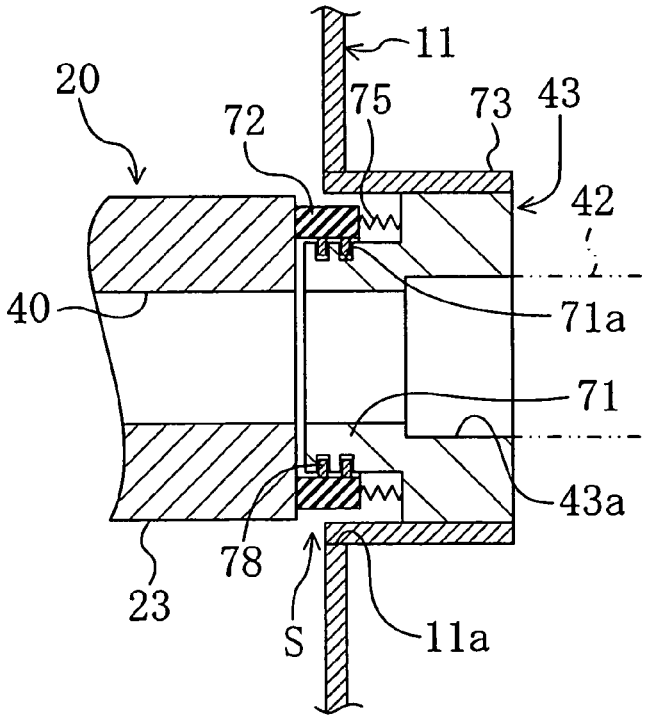
FIG. 11 is a view corresponding to FIG. 3 according to Modified Example 3 of Embodiment 2.

The O ring (76) is fitted in the inner peripheral groove (72*a*) of the sealing member (72) in Embodiment 2, but the following construction may be employed instead. Namely, as shown in FIG. 11, it is possible that the sealing member (72) is formed in a simple cylindrical shape, an outer peripheral groove (71*a*) is formed in the outer peripheral face of the cylindrical portion (71), and a ring member (78) is fitted in the outer peripheral groove (71*a*).

In the present modified example, the sealing member is made of metal and formed in a ring shape rectangular in section. Namely, the sealing member (72) is in a comparatively short cylindrical shape extending in the axial direction of the coupling member (43). The inner diameter of the sealing member (72) is slightly larger than the outer diameter of the cylindrical portion (71). Wherein, the sealing member (72) is in a simple cylindrical shape with no inner peripheral groove (72*a*) formed.

Further, two outer peripheral grooves (71*a*) are formed around the entire perimeters of two parts in the outer peripheral face of the cylindrical portion (71) which face the inner peripheral face of the sealing member (72). Metal ring members (78) are fitted in the two outer peripheral grooves (71*a*). The ring members (78) have the same shape as a piston ring used in an engine for an automobile or the like. Specifically, the ring members (78) are formed in such a shape that a part of a ring is cut out so as to be elastically deformed in the radial direction by application of external force.

The ring members (78) fitted in the outer peripheral grooves (71*a*) are surrounded by the sealing member (72) and compressed and contracted in the radial direction so as to be elastically deformed. The outer peripheral faces of the thus elastically deformed ring members (78) are pressed against the inner peripheral face of the sealing member (72) by restoring force of the ring members (78) which expands naturally in the radial direction. The ring members (78) fitted in the outer peripheral grooves (71*a*) are pressed against the inner peripheral face of the sealing member (72), thereby sealing the gap between the cylindrical portion (71) and the sealing member (72).

It is noted that the sealing member (72) may be made of resin such as polytetrafluoroethylene, polyphenylene sulfide resin, polyamide resin, polyether ketone resin, phenolic resin, and the like, carbon, ceramic, or the like. The ring member (78) may be made of resin such as polytetrafluoroethylene, polyphenylene sulfide resin, polyamide resin, polyether ketone resin, phenolic resin, and the like. Further, as the ring member (78), any of the above resins may be jointed to form inner and outer portions or a metal the surface of which is coated with any of the above resins may be used.

Further, FIG. 11 shows the two outer peripheral grooves (71*a*) formed in the cylindrical portion (71) and the ring members (78) fitted in the outer peripheral grooves (71*a*). However, the present embodiment is not limited thereto and only one outer peripheral groove (71*a*) may be formed in which the ring member (78) is fitted.

In the present modified example, the gap between the cylindrical portion (71) and the sealing member (78) is sealed by pressing the ring members (78) fitted in the outer peripheral grooves (71*a*) by restoring force of the ring members (78) which expands naturally in the radial direction. Therefore, according to the present modified example, the sealing mechanism (S) composed of the outer peripheral grooves (71*a*) and the ring members (78) secures the sealing between the cylindrical portion (71) and the sealing member (72).

In addition, in the present modified example, frictional drag is caused between the metal ring members (78) and the metal sealing member (72). In the case where O rings are fitted in the outer peripheral grooves (71*a*), for example, frictional drag is caused between the O rings, which is made of rubber, and the sealing member (72), which is made of metal. Frictional drag between metals is smaller than frictional drag between metal and rubber. Accordingly, the frictional drag between the metal sealing member (72) and the metal ring members (78) is smaller than the frictional drag between the metal sealing member (72) and the rubber O rings. Thus, according to the present modified example, sliding resistance between the ring member (78) and the sealing member (72) in displacement of the compression mechanism (20) in association with vibration of the compression mechanism (20) can be minimized and the sealing member (72) can follow the displacement of the compression mechanism (20) further reliably. In addition, the degree of freedom in displacement of the compression mechanism (20) can be reserved to reduce vibration transferring from the compression mechanism (20) to the sealed container (10).

Embodiment 3

Embodiment 3 of the present invention is a modification in the construction of the compressor in Embodiment 1. Herein, only different features from Embodiment 1 will be described.

Figure 12:
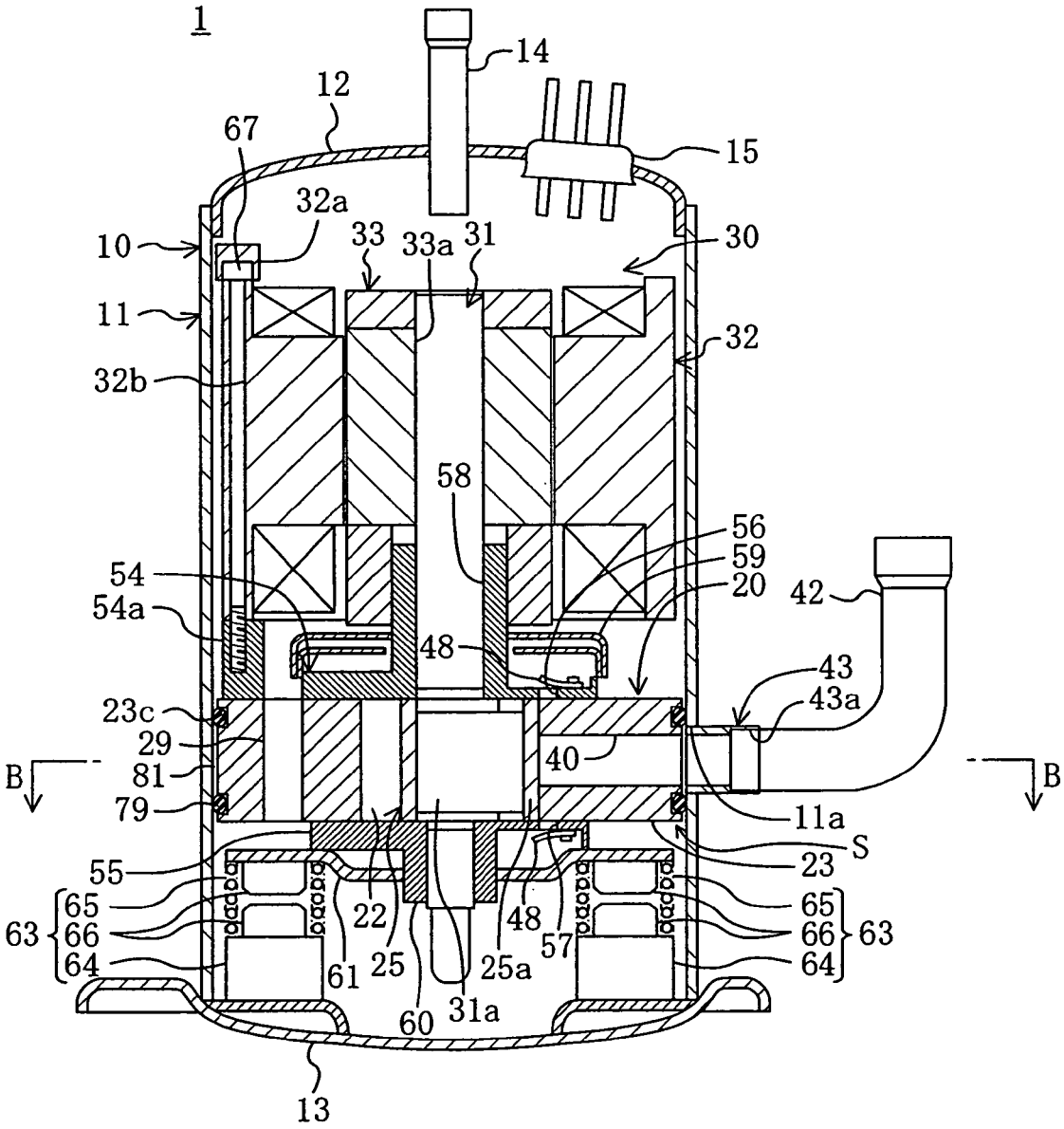
FIG. 12 is a view corresponding to FIG. 1 according to Embodiment 3.
Figure 13:
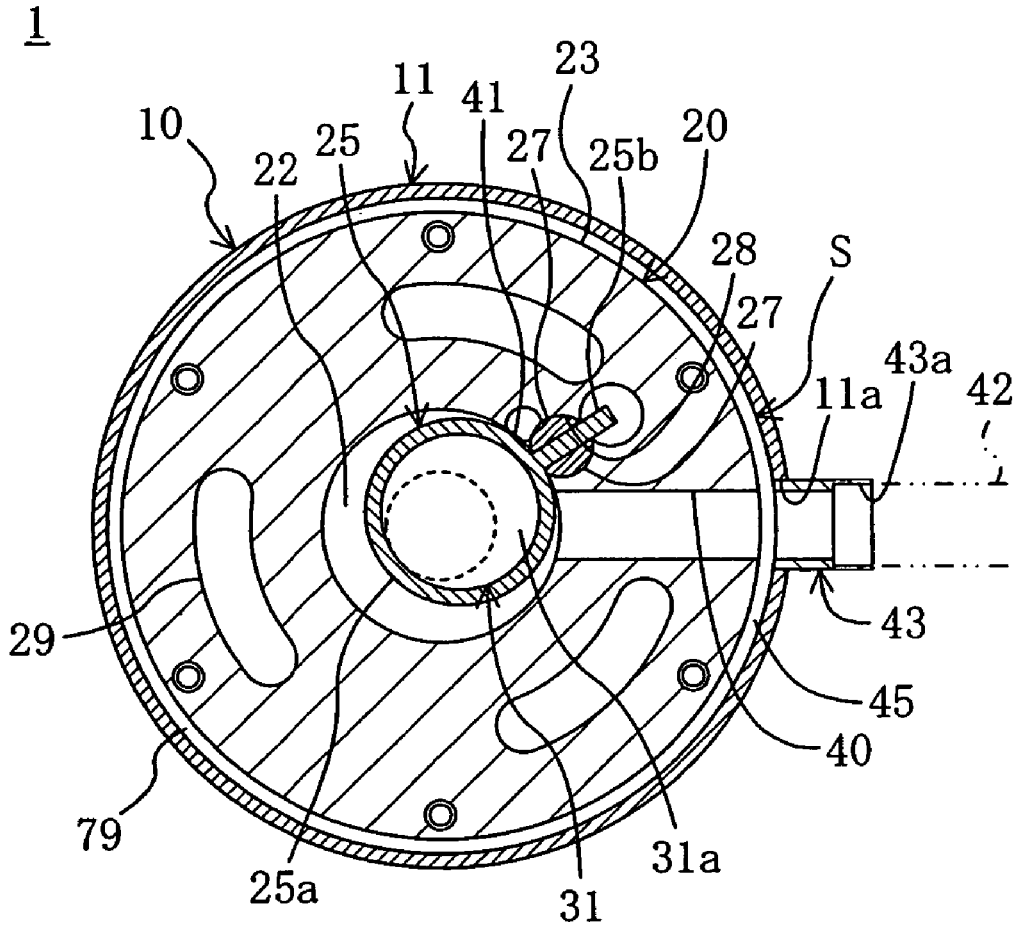
FIG. 13 is a section taken along the line B-B in FIG. 12.

As shown in FIG. 12 and FIG. 13, the compressor (1) of the present embodiment omits the block member (46), the intake pressure chamber (50), and the communication passage (51). Further, a coupling member (43) in the present embodiment is different in shape from that in Embodiment 1.

The coupling member (43) in the present embodiment is in a cylindrical shape. One end of the intake pipe (42) is inserted in and fixed to the base end part of the through hole (43*a*) formed in the coupling member (43). The lower level and the upper level of the coupling side insertion hole (11*a*) formed in the shell (11) of the sealed container (10) are higher and lower than the compression mechanism (20), respectively. The tip end of the coupling member (43) is inserted in the coupling side insertion hole (11*a*) by the same length as the thickness of the shell (11) and the entire perimeter of the outer peripheral face of the coupling member (43) is welded around the perimeter of the coupling side insertion hole (11*a*). The tip end face of the coupling member (43) is curved so as to conform to the inner peripheral face of the sealed container (10), forming a part of the inner peripheral face of the sealed container (10).

The cylinder (23) of the compression mechanism (20) is formed in a cylindrical shape having an outer diameter slightly smaller than the inner diameter of the sealed container (10). The compression mechanism (20) is arranged in such a fashion that the entire outer peripheral face of the cylinder (23) faces the inner peripheral face of the sealed container (10). A comparatively narrow annular gap is formed between the outer peripheral face of the cylinder (23) and the inner peripheral face of the sealed container (10). The opening part of the intake passage (40) in the outer peripheral face of the cylinder (23) is curved so as to conform to the outer peripheral face of the cylinder (23). A comparatively narrow annular gap is formed between the opening part of the intake passage (40) and the inner peripheral face of the sealed container (10). Further, a plurality of oil return passages (29) for allowing the refrigerator oil separated from the discharge gas to pass therethrough are formed in the cylinder (23) so as to pass through the cylinder (23) in the axial direction.

Concave grooves (23*c*) are formed around the entire perimeters in an upper part and a lower part of the outer peripheral face of the cylinder (23). The upper concave groove (23*c*) is formed in a part higher than the opening part of the intake passage (40) and the lower end thereof is located substantially the same height as or slightly upper than the upper level of the coupling side insertion hole (11*a*). The lower concave groove (23*c*) is formed in a part lower than the opening part of the intake passage (40) and the upper end thereof is located substantially the same height as or slightly lower than the lower level of the coupling side insertion hole (11*a*).

O rings (79) are fitted to the two concave grooves (23*c*), and have a thickness greater than the depth thereof. Further, the O rings (79) adhere to both the bottom faces of the concave grooves (23*c*) and the inner face of the sealed container (10) to be squeezed and crushed between the cylinder (23) and the sealed container (10). Adhesion of the O rings (79) to both the cylinder (23) and the sealed container (10) attains sealing between the cylinder (23) and the sealed container (10). Crushing in advance of the O rings (79) keeps the O rings (79) adhering to both the cylinder (23) and the sealed container (10) even when the cylinder (23) is displaced in the operation of the compressor (1).

In the present embodiment, the concave grooves (23*c*) formed in the cylinder (23) and the O rings (79) fitted therein compose the sealing mechanism (S). In the gap between the outer peripheral face of the cylinder (23) and the inner peripheral face of the sealed container (10), a space partitioned by the upper and lower O rings (79) forms a low-pressure space (81). The low-pressure space (81) is separated from the inner space of the sealed container (10) filled with the discharge gas and communicates with the intake passage (40) and the intake pipe (42). The hermeticity of the low-pressure space (81) is kept by the O rings (79) adhering to the cylinder (23) and the sealed container (10).

In the present embodiment, low-pressure intake gas is introduced into the intake passage (40) of the compression mechanism (20) through the intake pipe (42). When taking account of the fact that the discharge gas works on the entirety of the outer peripheral face of the compression mechanism (20) other than the intake passage (40), the gas pressure working in the radial direction on the compression mechanism (20) may become uneven. When the compression mechanism (20) is urged towards the intake pipe (42) by the gas pressure so as to be in contact with the sealed container (10), vibration transferring from the compression mechanism (20) to the sealed container (10) is interrupted insufficiently.

As described above, in the present embodiment, the low-pressure space (81) is formed at the entire perimeter of a part of the gap between the outer peripheral face of the compression mechanisms (20) and the inner peripheral face of the sealed container (10). Accordingly, the inner pressure of the low-pressure space (81), that is, the intake gas pressure works on the entire perimeter of the outer peripheral face of the compression mechanism (20). Thus, uniform gas pressure works in the radial direction of the compression mechanism (20), so that the compression mechanism (20) receives no influence of the gas pressure. This prevents displacement of the compression mechanism (20) towards the intake pipe (42) by the gas pressure to prevent the compression mechanism (20) from being in contact with the sealed container (10), thereby interrupting vibration transferring from the compression mechanism (20) to the sealed container (10) further reliably.

In the present embodiment, the concave grooves (23*c*) formed in the cylinder (23) of the compression mechanism (20) and the O rings (79) fitted therein compose the sealing mechanism (S). Hence, according to the present embodiment, the O rings (79) can slide on the inner peripheral face of the sealed container (10) even when the compression mechanism (20) is displaced in association with vibration of the compression mechanism (20), to attain sealing of the gap between the compression mechanism (20) and the sealed container (10) firmly. Further, the sealing mechanism (S) can be attained with the above simple construction, suppressing increase in cost of the compressor which is involved by provision of the sealing mechanism (S).

Further, in the present embodiment, the oil return passages (29) are provided in the compression mechanism (20). In many cases, a space filled with the discharge gas is arranged on the opposite side to a space in which the refrigerator oil is stored with the compression mechanism (20) interposed in the sealed container (10). With no oil return passages (29), the refrigerator oil separated from the gas would be stored in the space filled with the discharge gas to cause short of the refrigerator oil, inviting lubrication failure of the compression mechanism (20).

In contrast, in the present embodiment, the oil return passages (29) are formed in the compression mechanism (20), so that the refrigerator oil separated from the gas is lead through the oil return passages (29) to the space in which the refrigerator oil is stored.

Hence, according to the present embodiment, the shortage of the refrigerator oil can be prevented and lubrication failure of the compression mechanism (20) is obviated even with the construction in which the sealed container (10) is partitioned so that the refrigerator oil stored in one space is discharged to the other space. Further, provision of the oil return passages (29) keeps the pressure in the sealed container (10) uniformly.

Modified Example of Embodiment 3

In Embodiment 3, the construction of the compressor (1) may be changed. Herein, the features of the present modified example different from Embodiment 3 will be described.

Figure 14:
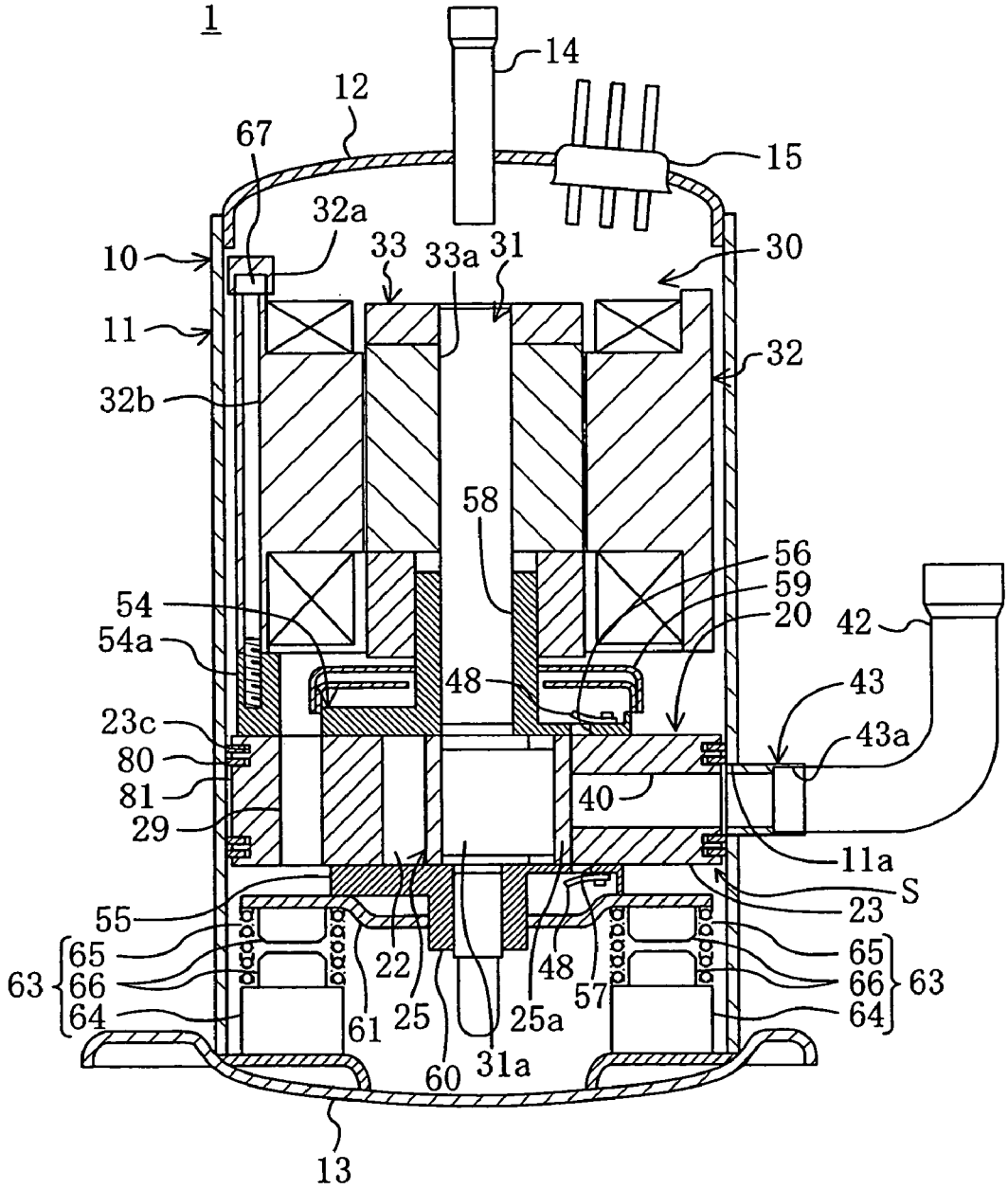
FIG. 14 is a view corresponding to FIG. 1 according to Modified Example of Embodiment 3.

As shown in FIG. 14, in the present modified example, each two concave grooves (23*c*) are formed in the upper and lower parts of the cylinder (23). A lower one of the two upper concave grooves (23*c*) is formed in a part higher than the opening part of the intake passage (40) and the lower end thereof is located substantially the same height as or slightly upper than the upper level of the coupling side insertion hole (1*a*). A higher one of the two lower concave grooves (23*c*) is formed in a part lower than the opening part of the intake passage (40) and the upper end thereof is located substantially the same height as or slightly lower than the lower level of the coupling side insertion hole (11*a*).

A metal ring member (80) is fitted in each of the plural concave grooves (23*c*, 23*c*, . . . ). Each ring member (80) has the same shape as that of a piston ring used in an engine for an automobile or the like. Specifically, the ring members (80) are in an annular shape a part of which is cut out so as to be elastically deformed in the radial direction by application of external force.

The ring members (80) fitted to the concave grooves (23*c*) are surrounded by the sealed container (10) and are compressed and contracted in the radial direction so as to be elastically deformed. The outer peripheral faces of the thus elastically deformed ring members (80) are pressed against the inner peripheral face of the sealed container (10) by restoring force of the ring members (80) which expands naturally in the radial direction. The pressing of the ring members (80) fitted in the concave grooves (23*c*) against the inner peripheral face of the sealed container (10) seals the gap between the cylinder (23) and the sealed container (10).

It is noted that the ring members (80) may be made of resin such as polytetrafluoroethylene, polyphenylene sulfide resin, polyamide resin, polyether ketone resin, phenolic resin, and the like. Further, as the ring member (78), any of the above resins may be jointed to form inner and outer portions or a metal the surface of which is coated with any of the above resins may be used.

Moreover, in FIG. 14, the two concave grooves (23*c*) are formed in each of the upper and lower parts of the cylinder (23) and the ring members (80) are fitted to the concave grooves (23*c*). However, the present invention is not limited thereto and it is possible that only one concave groove (23*c*) is formed in each of the upper and lower parts of the cylinder (23) and the ring member (80) is fitted to each concave groove (23*c*).

In the present embodiment, the concave grooves (23*c*) formed in the cylinder (23) of the compression mechanism (20) and the ring members (80) fitted therein compose the sealing mechanism (S). Each ring member (80) fitted in the concave grooves (23*c*) is pressed against the inner peripheral face of the sealed container (10) by restoring force thereof which expands naturally in the radial direction to seal the gap between the cylinder (23) and the sealed container (10). Hence, according to the present modified example, the ring members (80) can slide on the inner peripheral face of the sealed container (10) even when the compression mechanism (20) is displaced in association with vibration of the compression mechanism (20), thereby firmly sealing the gap between the compression mechanism (20) and the sealed container (10).

Furthermore, in the present modified example, frictional drag is caused between the metal ring members (80) and the metal sealed container (10). In the case where O rings are fitted in the concave grooves (23*c*), for example, frictional drag is caused between the O rings, which is made of rubber, and the sealed container (10), which is made of metal. Frictional drag between metals is smaller than frictional drag between metal and rubber. Accordingly, the frictional drag between the metal sealed container (10) and the metal ring members (78) is smaller than the frictional drag between the metal sealed container (10) and the rubber O rings (80). Thus, according to the present embodiment, sliding resistance between the ring members (78) and the sealed container (10) in displacement of the compression mechanism (20) in association with vibration of the compression mechanism (20) can be minimized and the gap between the compression mechanism (20) and the sealed container (10) can be sealed further firmly.

Other Embodiments

First Modified Example

In Embodiments 1 to 3, the present invention is applied to the rotary compressor (1) of rocking piston type in which the blade (25*b*) is formed with the piston (25) integrally and the piston (25) rocks in the cylinder (23), but the compressor directed to the present invention is not limited to the compressor of this type. For example, the present invention may be applied to a rotary compressor of rolling piston type in which a piston and a blade are formed separately and the tip end of the blade is pressed to the outer peripheral face of the piston. Further, the present invention is applicable to a scroll compressor.

Second Modified Example

In Embodiment 3, the concave grooves (23*c*) are formed in the outer face of the cylinder (23) and the O rings (79) or the ring members (80) are fitted in the concave grooves (23*c*). However, the present invention is not limited thereto and it is possible that the concave grooves (not shown) are formed in inner peripheral parts of the sealed container (10) and the O rings (79) or the ring members (80) are fitted therein. In this modified example, the parts of the outer peripheral face of the cylinder (23) which face the concave grooves of the sealed container (10) serves as the sealed face. Further, the concave grooves formed in the sealed container (10) and the O rings (79) or the ring members (80) fitted therein compose the sealing mechanism (S).

INDUSTRIAL APPLICABILITY

As described above, the present invention is useful for hermetic compressors in which a compression mechanism and a motor are accommodated in a sealed container, and is especially suitable for a compressor in which a compression mechanism and a motor are supported to a sealed container elastically.

What is claimed is:

1. A compressor comprising:

a cylindrical sealed container connected to an intake pipe and a discharge pipe;

a compression mechanism being disposed in the sealed container to compress gas introduced from the intake pipe and discharge the gas into the sealed container, the compression mechanism including a compression chamber configured to compress gas introduced from the intake pipe, a drive shaft movable about a rotation axis to operate the compression mechanism and an intake passage extending in a radial direction relative to the rotation axis, the intake passage having one end that opens at the compression chamber and an opposite end that opens in an outer lateral face of the compression mechanism to face a terminal end of the intake pipe, both of the ends of the intake passage being at least partially aligned with the compression chamber and the terminal end of the intake pipe as viewed in the radial direction along the intake passage;

a motor disposed in the sealed container and operatively connected to the drive shaft of the compression mechanism;

an elastic support member supporting the compression mechanism and the motor as an integrated unit within the sealed container for movement together with respect to the sealed container; and a sealing mechanism including a sealing member pressed against a sealed face formed by one of a peripheral part of the intake passage in the outer lateral face of the compression mechanism and a part of an inner face of the sealed container which faces the peripheral part to connect the intake pipe and the intake passage with each other by sealing a gap between the compression mechanism and the sealed container, the compression mechanism including an orbiting member that extends along the rotation axis to move between a pair of opposed axially facing surfaces that define axial ends of the compression chamber such that both of the ends of the intake passage are at least partially aligned with the orbiting member and the terminal end of the intake pipe as viewed in the radial direction along the intake passage.

2. The compressor of claim 1, wherein the part of the inner face of the sealed container serves as the sealed face, the outer lateral face of the compression mechanism has an annular concave groove that is formed to surround the opening part of the intake passage in the outer lateral face of the compression mechanism, and the sealing member is a ring shaped member, which is fitted in the concave groove and which is interposed between a bottom face of the concave groove and the sealed face so as to be deformed elastically therebetween.

3. The compressor of claim 2, wherein the sealing member is an O ring.

4. The compressor of claim 2, wherein the sealing member has a U-shaped cross sectional profile so as to be elastically deformed in a thickness direction.

5. The compressor of claim 1, wherein the sealed container includes a coupling member having a tip end face facing the peripheral part of the intake passage and a base end to which the intake pipe is mounted, the peripheral part of the intake passage serves as the sealed face, a tip end part of the coupling member has a cylindrical shape forming a cylindrical portion, the sealing member is a ring shaped member with a rectangular cross sectional profile and is fitted freely to the cylindrical portion, and the sealing mechanism includes a pressing member applying a pressing force on the sealing member so that a tip end face of the sealing member is in contact with the sealed face.

6. The compressor of claim 5, wherein the pressing member is a spring that contacts a base end face of the sealing member and the coupling member.

7. The compressor of claim 6, wherein the sealing member has an entire inner peripheral face in sliding contact with an outer peripheral face of the cylindrical portion.

8. The compressor of claim 5, wherein the sealing member has an inner peripheral groove formed around an entire perimeter of an inner peripheral face of the sealing member, and the sealing mechanism includes an O ring fitted in the inner peripheral groove and in contact with an outer peripheral face of the cylindrical portion.

9. The compressor of claim 5, wherein the pressing member is an O ring that contacts both a base end face of the sealing member and the coupling member.

10. The compressor of claim 1, wherein the sealed container includes a cylindrical shell extending vertically, an upper head that blocks an upper end of the shell, and a lower head that blocks a lower end of the shell, the upper head has a lower end that is fitted inside the shell, and one of the compression mechanism and the motor includes a stopper that restricts displacement of the compression mechanism and the motor by contacting the lower end of the upper head.

11. The compressor of claim 1, wherein the compression mechanism is arranged below the motor in the sealed container, the compression mechanism is fixed to the elastic support member by a plate-shaped stay member and has a discharge passage formed in a lower face of the compression mechanism for discharging compressed gas into the sealed container, and the stay member covers an opening part of the discharge passage in the lower face of the compression mechanism.

12. The compressor of claim 5, wherein the sealing mechanism includes an outer peripheral groove formed around an entire perimeter of an outer peripheral face of the cylindrical portion, and an annular split ring member fitted in the outer peripheral groove, with an outer peripheral face of the split ring member being pressed against an inner peripheral face of the sealing member by a restoring force of the split ring member which expands naturally in the radial direction to seal a gap between the cylindrical portion and the sealing member.

13. The compressor of claim 12, wherein the sealing member and the split ring member are made of metal.

14. The compressor of claim 1, further comprising:

a differential pressure canceling mechanism configured and arranged to make intake gas pressure work on the compression mechanism to reduce a pressing force by the discharge of the gas within the sealed container which works on the compression mechanism towards the intake pipe.

15. The compressor of claim 14, wherein the compression mechanism includes a rotary fluid machinery having the compression chamber formed between an inner peripheral face of a cylinder and an outer peripheral face of a piston that forms the orbiting member, and the differential pressure canceling mechanism is configured and arranged to make the intake gas pressure work on an outer face of the cylinder of the compression mechanism.

16. The compressor of claim 15, wherein the differential pressure canceling mechanism is configured and arranged to make the intake gas pressure work on a part opposite the intake passage in the outer face of the cylinder.

17. The compressor of claim 15, wherein the differential pressure canceling mechanism includes an intake pressure chamber formed between the inner face of the sealed container and the outer face of the cylinder to receive the intake gas pressure, and a communication passage fluidly connecting the intake pressure chamber with the intake passage of the compression mechanism such that the intake gas pressure of the intake pressure chamber works on the cylinder.

18. The compressor of claim 17, wherein the communication passage of the differential pressure canceling mechanism is formed in the cylinder.

19. The compressor of claim 17, wherein the communication passage of the differential pressure canceling mechanism is formed as an arc shape extending along the inner peripheral face of the cylinder.

20. A compressor comprising:

a cylindrical sealed container connected to an intake pipe and a discharge pipe;

a compression mechanism having a cylindrical outer shape and being disposed in the sealed container to compress gas introduced from the intake pipe and discharge the gas into the sealed container, the compression mechanism including a compression chamber configured to compress gas introduced from the intake pipe, a drive shaft movable about a rotation axis to operate the compression mechanism and an intake passage extending in a radial direction relative to the rotation axis, the intake passage having one end that opens at the compression chamber and an opposite end that opens in an outer peripheral face of the compression mechanism to face a terminal end of the intake pipe, both of the ends of the intake passage being at least partially aligned with the compression chamber and the terminal end of the intake pipe as viewed in the radial direction along the intake passage;

a motor disposed in the sealed container and operatively connected to the drive shaft of the compression mechanism;

an elastic support member supporting the compression mechanism and the motor as an integrated unit within the sealed container for movement together with respect to the sealed container; and a sealing mechanism configured and arranged in a gap between the outer peripheral face of the compression mechanism and an inner peripheral face of the sealed container that face each other to form a low-pressure space that communicates with the intake passage and the intake pipe, the compression mechanism including an orbiting member that extends along the rotation axis to move between a pair of opposed axially facing surfaces that define axial ends of the compression chamber such that both of the ends of the intake passage are at least partially aligned with the orbiting member and the terminal end of the intake pipe as viewed in the radial direction along the intake passage.

21. The compressor of claim 20, wherein the sealing mechanism has at least one O ring arranged around an entire perimeter of the outer peripheral face of the compression mechanism at each side of the opening part of the intake passage.

22. The compressor of claim 20, wherein the outer peripheral face of the compression mechanism has at least one concave groove formed around an entire perimeter in the outer peripheral face of the compression mechanism at each side of the opening part of the intake passage, the sealing mechanism includes an annular split ring member which is fitted in the concave grooves, and an outer peripheral face of the split ring member presses against the inner peripheral face of the sealed container by a restoring force of the split ring member which expands naturally in the radial direction to seal a gap between the compression mechanism and the sealed container.

23. The compressor of claim 22, wherein the split ring member is made of metal.

24. The compressor of claim 20, wherein the compression mechanism has an oil return passage extending in an axial direction of the compression mechanism.

* * * * *